US006867361B2

(12) United States Patent
Nishitani et al.

(10) Patent No.: US 6,867,361 B2
(45) Date of Patent: Mar. 15, 2005

(54) SYSTEM AND METHOD FOR GENERATING TONE IN RESPONSE TO MOVEMENT OF PORTABLE TERMINAL

(75) Inventors: Yoshiki Nishitani, Hamakita (JP); Eiko Kobayashi, Hamakita (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 10/092,405

(22) Filed: Mar. 5, 2002

(65) Prior Publication Data

US 2002/0088335 A1 Jul. 11, 2002

Related U.S. Application Data

(63) Continuation-in-part of application No. 09/948,065, filed on Sep. 5, 2001, now abandoned.

(30) Foreign Application Priority Data

Sep. 5, 2000 (JP) ..... 2000-269160
Sep. 5, 2001 (JP) ..... 2001-269131

(51) Int. Cl.[7] ..... G10H 1/00
(52) U.S. Cl. ..... 84/658; 84/730; 84/734
(58) Field of Search ..... 84/658, 730, 734, 84/600, 644, 670, 718–721, 738, 743–746

(56) References Cited

U.S. PATENT DOCUMENTS 4,753,146 A 6/1988 Seiler
4,905,560 A * 3/1990 Suzuki et al. ..... 84/600
5,027,688 A 7/1991 Suzuki et al.
5,046,394 A 9/1991 Suzuki et al.
5,058,480 A * 10/1991 Suzuki et al. ..... 84/600
5,062,341 A 11/1991 Reiling
5,117,730 A * 6/1992 Yamauchi ..... 84/723
5,125,313 A * 6/1992 Hiyoshi et al. ..... 84/600
5,147,969 A * 9/1992 Hiyoshi et al. ..... 84/600
5,170,002 A * 12/1992 Suzuki et al. ..... 84/600
5,177,311 A * 1/1993 Suzuki et al. ..... 84/600
5,218,159 A * 6/1993 McClish ..... 84/731
5,290,964 A 3/1994 Hiyoshi et al.
5,313,010 A 5/1994 Matsushima et al.
RE34,700 E * 8/1994 Suzuki et al. ..... 84/600
5,350,881 A * 9/1994 Kashio et al. ..... 84/622
5,512,703 A 4/1996 Usa
5,714,706 A 2/1998 Nakada
5,736,665 A * 4/1998 Fukumoto et al. ..... 84/667
5,920,024 A 7/1999 Moore
6,297,438 B1 * 10/2001 Por Paul ..... 84/600
6,326,539 B1 * 12/2001 Mishima ..... 84/723

FOREIGN PATENT DOCUMENTS

JP 401277293 A * 4/1988 ..... G10H/1/053
JP 04093997 A * 3/1992 ..... G10H/1/053

* cited by examiner

*Primary Examiner*—Marlon T. Fletcher
*Assistant Examiner*—David S. Warren
(74) *Attorney, Agent, or Firm*—Morrison & Foerster LLP

(57) ABSTRACT

Operation terminal capable of being carried by a user or human operator is, for example, in the form of a bar or shoe, and detection is made of a movement trajectory of the operation terminal on the basis of movement of the operation terminal. Tone signal is generated with a desired tone factor, such as a tone color, tone volume, tone pitch or effect, set or controlled on the basis of the detected movement trajectory of the operation terminal. Also, detection is made of a mechanical amount of the operation terminal corresponding to a motion of the user carrying the operation terminal, such as an amount of displacement of a predetermined portion (e.g. a shoe's heel portion) of the operation terminal or pressure applied to the predetermined portion, so that a tone signal is generated with a desired tone factor set or controlled on the basis of the detected mechanical amount.

17 Claims, 18 Drawing Sheets

| TRAJECTORY SHAPE (DIRECTION INCLUDED) | TONE COLOR |
|---|---|
| CIRCULAR SHAPE OF ONE CLOCKWISE REVOLUTION | PIANO |
| CIRCULAR SHAPE OF ONE COUNTERCLOCKWISE REVOLUTION | WIND |
| SHAPE OF NUMERAL "8" (BOTH DIRECTIONS) | WAVE |
| OBLIQUELY-CUT SURFACE SHAPE (DOWNWARD) | HANDCLAP |
| OBLIQUELY-CUT SURFACE SHAPE (UPWARD) | DRUM |
| ⋮ | ⋮ |

| TRAJECTORY SIZE | TONE VOLUME |
|---|---|
| SMALL | SMALL |
| MEDIUM | MEDIUM |
| GREAT | GREAT |

| MOVING SPEED | SCALE NOTE |
|---|---|
| A | C |
| B | D |
| C | E |
| D | F |
| E | G |
| ⋮ | ⋮ |

| | | |
|---|---|---|
| SHAPE INFO. | = | "CIRCULAR TRAJECTORY SHAPE OF ONE REVOLUTION" |
| SIZE INFO. | = | "RADIUS R" |
| DIRECTION INFO. | = | "CLOCKWISE" |
| SPEED INFO. | = | "V" |

INFO. TO BE GENERATED

"8" SHAPE

OBLIQUELY-CUT SURFACE SHAPE

RECTANGULAR

SPIRAL

| SHAPE FLAG | PREDETERMINED COUNT | NP1 | NP2 | NP3 | NP4 | NP5 | NP6 | NP7 | NP8 |
|---|---|---|---|---|---|---|---|---|---|
| CLOCKWISE CIRCLE | 4 | RIGHT DOWNWARD | LEFT DOWNWARD | LEFT UPWARD | RIGHT UPWARD | | | | |
| COUNTERCLOCKWISE CIRCLE | 4 | LEFT DOWNWARD | RIGHT DOWNWARD | RIGHT UPWARD | LEFT UPWARD | | | | |
| CLOCKWISE RECTANGLE | 4 | RIGHTWARD | STRAIGHT DOWNWARD | LEFTWARD | STRAIGHT UPWARD | | | | |
| COUNTERCLOCKWISE RECTANGLE | 4 | STRAIGHT DOWNWARD | RIGHTWARD | STRAIGHT UPWARD | LEFTWARD | | | | |
| CLOCKWISE TRIANGLE | 3 | RIGHT DOWNWARD | LEFTWARD | RIGHT UPWARD | | | | | |
| COUNTERCLOCKWISE TRIANGLE | 3 | LEFT DOWNWARD | RIGHTWARD | LEFT UPWARD | | | | | |
| CLOCKWISE 8 | 8 | RIGHT UPWARD | RIGHT DOWNWARD | LEFT DOWNWARD | LEFT UPWARD | LEFT UPWARD | LEFT DOWNWARD | RIGHT DOWNWARD | RIGHT UPWARD |
| COUNTERCLOCKWISE 8 | 8 | LEFT UPWARD | LEFT DOWNWARD | RIGHT DOWNWARD | RIGHT UPWARD | RIGHT UPWARD | RIGHT DOWNWARD | LEFT DOWNWARD | LEFT UPWARD |

FIG. 9

| TRAJECTORY SHAPE (DIRECTION INCLUDED) | TONE COLOR |
|---|---|
| CIRCULAR SHAPE OF ONE CLOCKWISE REVOLUTION | PIANO |
| CIRCULAR SHAPE OF ONE COUNTERCLOCKWISE REVOLUTION | WIND |
| SHAPE OF NUMERAL "8" (BOTH DIRECTIONS) | WAVE |
| OBLIQUELY-CUT SURFACE SHAPE (DOWNWARD) | HANDCLAP |
| OBLIQUELY-CUT SURFACE SHAPE (UPWARD) | DRUM |
| ⋮ | ⋮ |

| TRAJECTORY SIZE | TONE VOLUME |
|---|---|
| SMALL | SMALL |
| MEDIUM | MEDIUM |
| GREAT | GREAT |

| MOVING SPEED | SCALE NOTE |
|---|---|
| A | C |
| B | D |
| C | E |
| D | F |
| E | G |
| ⋮ | ⋮ |

FIG. 18

SYSTEM AND METHOD FOR GENERATING TONE IN RESPONSE TO MOVEMENT OF PORTABLE TERMINAL

RELATED APPLICATION

The present application is a continuation-in-part application of U.S. patent application Ser. No. 09/948,065 filed Sep. 5, 2001 now abandoned.

BACKGROUND OF THE INVENTION

The present invention relates to a tone signal generation system, apparatus and method for generating tone signals in response to actions or motions of a human operator or user.

Tone generation apparatus, such as audio equipment, can generate a desired tone, once four major performance parameters, i.e. tone color, tone pitch, tone volume and effect, have been determined. In the case of CD (Compact Disk) players or similar tone generation apparatus, a performance of a music piece is reproduced on the basis of music piece data recorded on a CD, and it has been conventional for users to adjust parameters, such as tone volume, by manipulating a corresponding knob, button and/or other manual operator.

Namely, in the conventional CD players, the users adjust, as appropriate, the corresponding knob, button and/or other manual operator to obtain a desired tone volume and/or the like. Although the performance parameter adjustment via the manual operators is effective in cases where the users listen to the performance, reproduced by the tone generation apparatus, with the desired tone volume and/or the like, new ways of enjoying music could be provided if the tone generation apparatus allow the users to positively take part in a music piece performance rather than being limited to the function of only faithfully reproducing a performance of a designated music piece. Of course, using various types of existing (conventionally-known) acoustic and musical instruments may permit a variety of music pieces to be performed as desired; however, new forms of musical entertainment could be provided if arrangements are made for generating tones reflecting user's motions such as gestures.

SUMMARY OF THE INVENTION

In view of the foregoing, it is an object of the present invention to provide a tone signal generation system, apparatus and method for generating a tone signal reflecting a user's motion.

In order to accomplish the above-mentioned object, the present invention provides a tone signal generation system which comprises: an operation terminal that is capable of being carried by a human operator and that generates and transmits motion information corresponding to a motion of the human operator carrying the operation terminal; and a tone signal generation apparatus that receives the motion information from the operation terminal and detects a movement trajectory of the operation terminal corresponding to the motion of the human operator on the basis of the received motion information. The tone signal generation apparatus generates a tone signal on the basis of the detected movement trajectory of the operation terminal.

In one embodiment of the present invention, the tone signal generation apparatus includes a table storing at least one possible movement trajectory of the operation terminal and at least one tone signal in association with each other, so that the tone signal generation apparatus generates a tone signal by referring to stored contents of the table.

The stored contents of the table are rewritable.

In one embodiment, the tone signal generation apparatus determines a first parameter for generating a tone signal in accordance with a shape of the movement trajectory of the operation terminal, a second parameter for generating a tone signal in accordance with a size of the movement trajectory, and a third parameter for generating a tone signal in accordance with a moving speed or acceleration of the movement trajectory.

According to another aspect of the present invention, there is provided a tone signal generation system which comprises: an operation terminal that is capable of being carried by a human operator and that detects a mechanical amount of the operation terminal corresponding to a motion of the human operator carrying the operation terminal, such as an amount of displacement of a predetermined portion of the operation terminal or pressure applied to the predetermined portion, and transmits information indicative of the detected mechanical amount; and a tone signal generation apparatus that receives the information indicative of the detected mechanical amount from the operation terminal and generates a tone signal on the basis of the received information indicative of the detected mechanical amount.

As one example, the operation terminal is in the form of a shoe wearable by the human operator, and the predetermined portion is a bottom of the shoe.

As another example, the operation terminal is in the form of a stick, and the predetermined portion is a tip portion of the stick.

According to still another aspect of the present invention, there is provided a tone signal generation apparatus capable of being carried by a human operator, which comprises: a sensor section that generates motion information corresponding to a motion of the human operator carrying the tone signal generation apparatus; a processing section that detects a movement trajectory of the tone signal generation apparatus corresponding to the motion of the human operator on the basis of the motion information generated by the sensor section; and a tone signal generation section that generates a tone signal on the basis of the movement trajectory detected by the processing section.

According to still another aspect of the present invention, there is provided a tone signal generation apparatus capable of being carried by a human operator, which comprises: a detection section that detects a mechanical amount of the tone signal generation apparatus corresponding to a motion of the human operator carrying the tone signal generation apparatus, such as an amount of displacement of a predetermined portion of the tone signal generation apparatus or pressure applied to the predetermined portion; and a tone signal generation section that generates a tone signal on the basis of information indicative of the mechanical amount detected by the detection section.

The present invention may be constructed and implemented not only as the system or apparatus invention as discussed above but also as a method invention. Also, the present invention may be arranged and implemented as a software program for execution by a processor such as a computer or DSP, as well as a storage medium storing such a program. Further, the processor used in the present invention may comprise a dedicated processor with dedicated logic built in hardware, not to mention a computer or other general-purpose type processor capable of running a desired software program.

While the embodiments to be described herein represent the preferred form of the present invention, it is to be understood that various modifications will occur to those skilled in the art without departing from the spirit of the invention. The scope of the present invention is therefore to be determined solely by the appended claims.

BRIEF DESCRIPTION OF THE DRAWINGS

For better understanding of the object and other features of the present invention, its embodiments will be described in greater detail hereinbelow with reference to the accompanying drawings, in which:

FIG. 9 is a diagram explanatory of stored contents of a trajectory shape recognizing table to be used for detecting a movement trajectory of the operation terminal;

FIG. 18 is a diagram showing exemplary stored contents of a tone signal table to be used for tone signal generation in the personal computer system;

DETAILED DESCRIPTION OF EMBODIMENTS

Figure 1:
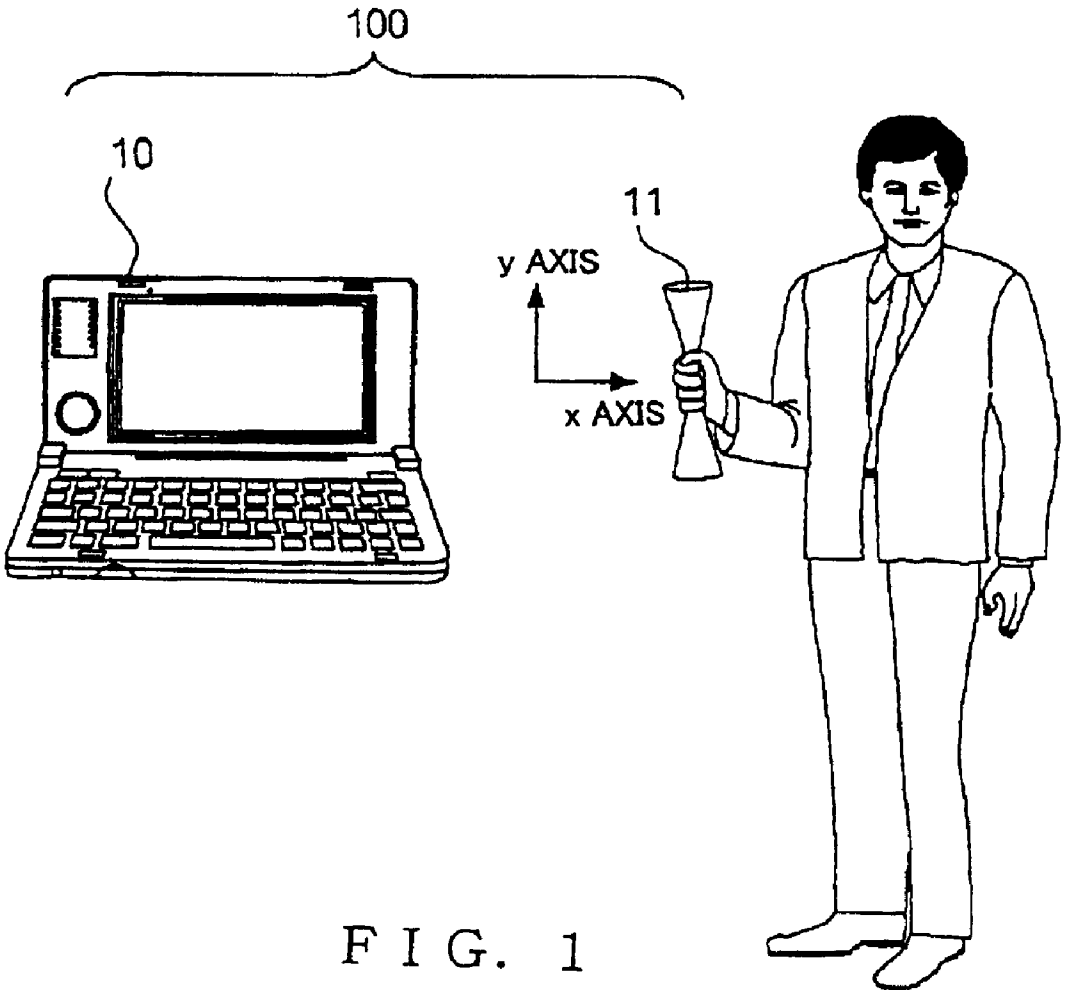
FIG. 1 is a view showing an overall external appearance of a tone signal generation system in accordance with a first embodiment of the present invention.

A. First Embodiment:

A-1. Construction:

FIG. 1 is a view schematically showing an overall external appearance of a tone signal generation system in accordance with a first embodiment of the present invention. As shown, the tone signal generation system 100 includes a personal computer system 10 and an operation terminal 11 that can be easily carried by a user or human operator.

In the instant embodiment, the operation terminal 11 has a bar-like trajectory in external appearance; more specifically, the operation terminal 11 is generally in a "dual frustum-of-cone" trajectory and has a diameter progressively decreasing from it opposite ends toward its middle. In use, the human operator grasps a smaller-diameter middle portion of the operation terminal 11 to move the operation terminal 11. In the tone signal generation system 100, the personal computer system 10 is arranged to generate tones signals corresponding to movements of the operation terminal 11 grasped by the human operator, i.e. motions of a hand of the human operator grasping the operation terminal 11. The operation terminal 11 employed in the instant embodiment is not limited to the aforementioned type that has the diameter progressively decreasing from the opposite ends toward the middle and that is grasped by the human operator. For example, the operation terminal 11 may be attached to an arm, foot or leg using a fastening band or the like and may have any other trajectory; that is, the operation terminal 11 may have any desired trajectory and may be attached to the human operator at any desired portion of the human operator's body and in any desired manner.

Figure 2:
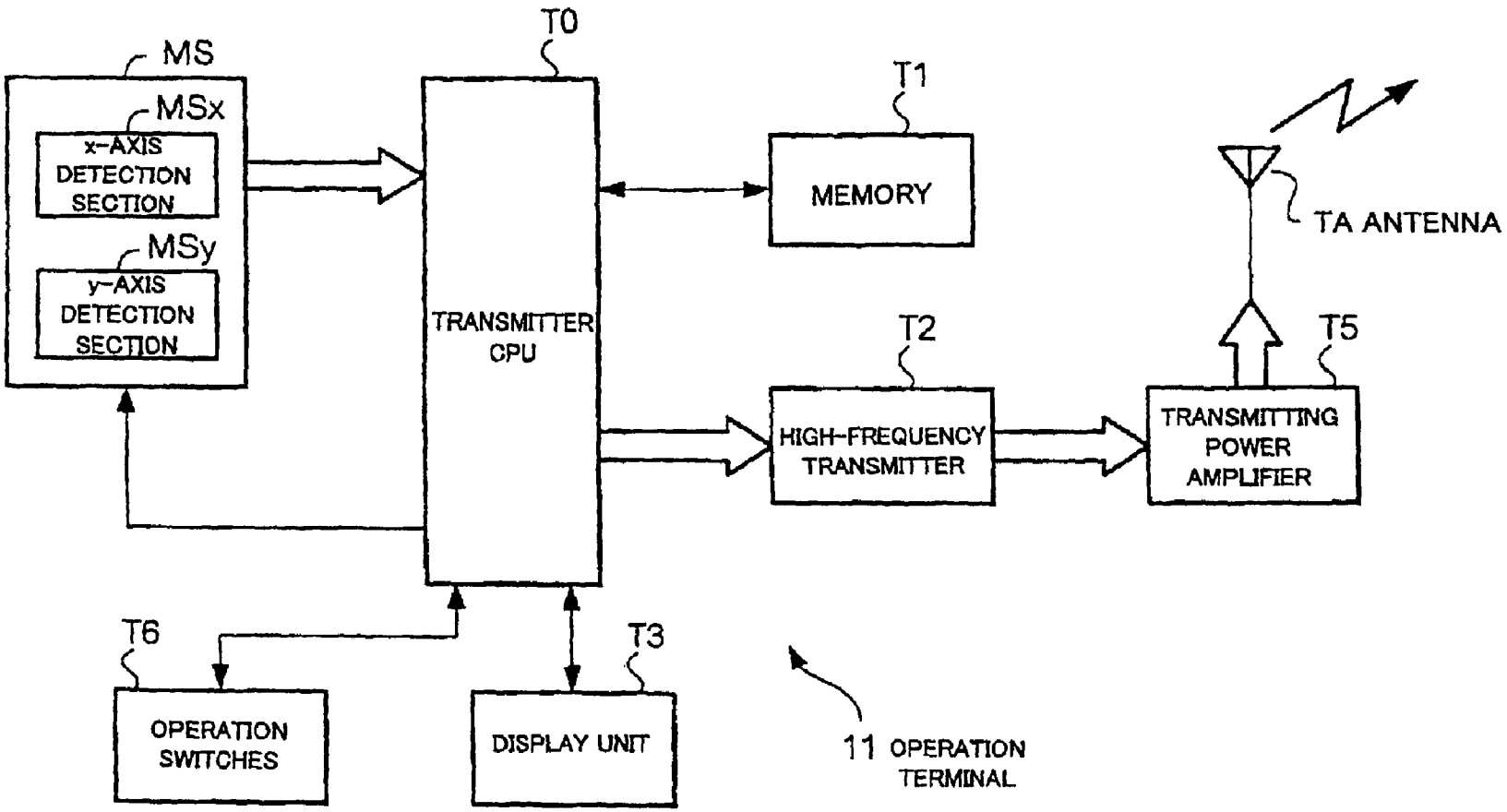
FIG. 2 is a block diagram showing an exemplary setup of an operation terminal in the tone signal generation system of FIG. 1.

FIG. 2 is a block diagram showing an exemplary setup of the operation terminal 11 in the first embodiment. As shown, the operation terminal 11 includes a motion sensor MS, a transmitter CPU T0, a memory T1, a high-frequency transmitter T2, a display unit T3, a transmitting power amplifier T5, operation switches T6, and a transmitting antenna TA.

When the operation terminal 11 is in use, i.e. when tone signals are to be generated via the tone signal generation system 100, the motion sensor MS detects motions of the human operator carrying the operation terminal 11 (e.g., movements of the human operator's hand in the case where the operation terminal 11 is grasped with the hand of the human operator as illustrated in FIG. 1), to generate motion information. As such a motion sensor MS, there may be used a three-dimensional acceleration sensor, three-dimensional speed sensor, two-dimensional acceleration sensor, two-dimensional speed sensor or the like. In the illustrated example, the motion sensor MS comprises a two-dimensional acceleration sensor, which includes an x-axis detection section MSx and a y-axis detection section MSy. These x-axis and y-axis detection sections MSx and MSy detect acceleration in the x-axis (horizontal) and y-axis (vertical) directions, respectively.

The transmitter CPU T0 controls the above-mentioned motion sensor MS, high-frequency transmitter T2 and display unit T3 on the basis of a transmitter operating program stored in the memory T1. Each detection signal output from the motion sensor MS is fed to the transmitter CPU T0, by which the signal is subjected to predetermined processes such as an ID-number imparting process. The thus-processed detection signal is delivered to the high-frequency transmitter T2, amplified via the transmitting power amplifier T5, and then wirelessly transmitted via the transmitting antenna TA to the personal computer system 10.

Figure 3:
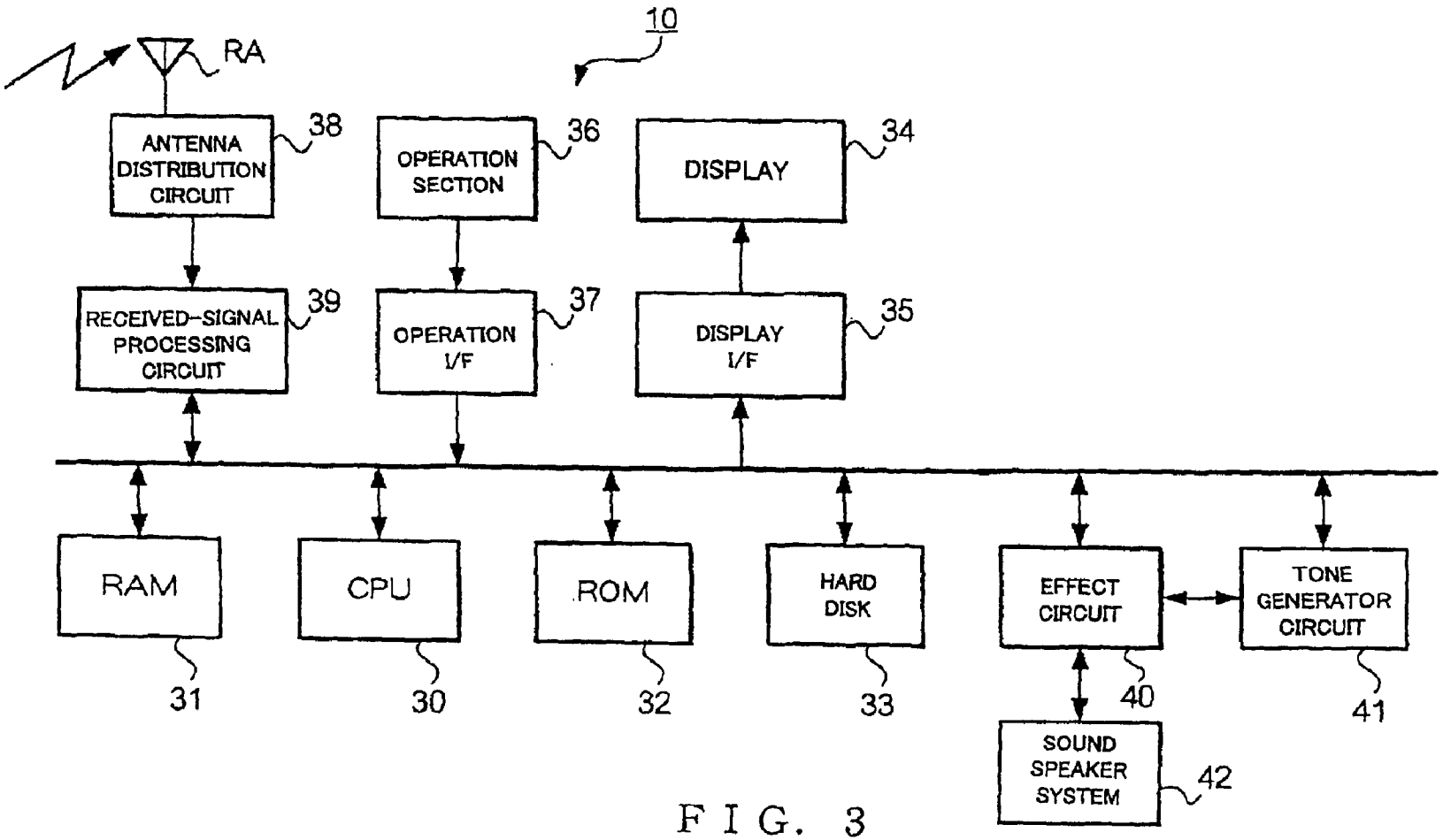
FIG. 3 is a block diagram showing an exemplary hardware setup of a personal computer system in the tone signal generation system of FIG. 1.

The display unit T3 includes seven-segment LEDs or LCD (Liquid Crystal Display) and one or more LEDs, which displays various information such as a sensor number, message "In Operation" and power alarm. The operation switches T6 are used for turning on/off the power to the operation terminal 11 and making various settings such as a mode setting. Driving power is supplied to the individual components of the operation terminal 11 from a battery (not shown) that may be either a primary battery or a rechargeable secondary battery The personal computer system 10 comprises an ordinary-type personal computer that has a function of receiving the radio signals from the above-described operation terminal 11, a tone generating function and other functions. FIG. 3 is a block diagram showing an exemplary hardware setup of the personal computer system 10 employed in the first embodiment. As shown, the personal computer system 10 includes a CPU (Central Processing Unit) 30 that performs various arithmetic operations and controls various components of the system 10, a RAM (Random Access Memory) 31 to be used as a working memory of the CPU 30, and a ROM (Read-Only Memory) 32 storing a group of programs to be read out and executed by the CPU 30. The personal computer system 10 also includes a hard disk 33 storing programs such as an operating system and application programs to be read out and executed by the CPU 30, a display device 34, such as a CRT (Cathode Ray Tube), for displaying images or pictures to the user, a display interface (I/F) 35 for causing the display device 34 to display pictures and graphics corresponding to data supplied by the CPU 30, and an operation section 36 including a keyboard, mouse, etc. to be used by the user to enter a desired instruction. The personal computer system 10 further includes an operation interface (I/F) 37 for supplying the CPU 30 with data indicative of the instruction entered via the operation section 36, an antenna distribution circuit 38 for receiving, via an antenna RA, the radio signal transmitted from the operation terminal 11 (see FIGS. 1 and 2), and a received-signal processing circuit 39 for taking in the radio signal, received by the antenna distribution circuit 38, after converting the signal into data representation that can be processed by the CPU 30. The personal computer system 10 further includes a tone generator circuit 41 for generating a tone signal, an effect circuit 40 including a DSP (Digital Signal Processor) for imparting an effect to the tone signal generated by the tone generator circuit 41, and a sound speaker system 42 for audibly generating a tone on the basis of the effect-imparted tone signal output from the effect circuit 40. Note that the hard disk 33 is written and read by the CPU 30 and also used for storing music piece data and the like.

The personal computer system 10 is arranged to perform a tone generation process in response to motion information transmitted from the operation terminal 11 by the CPU 30 executing tone generation processing programs stored in the ROM 32 and hard disk 33 in accordance with a user instruction entered via the operation section 36 while the power is on. The following paragraphs describe various functions and construction of the personal computer system 10 focusing on the tone generation process, with primary reference to FIG. 4.

Figure 4:
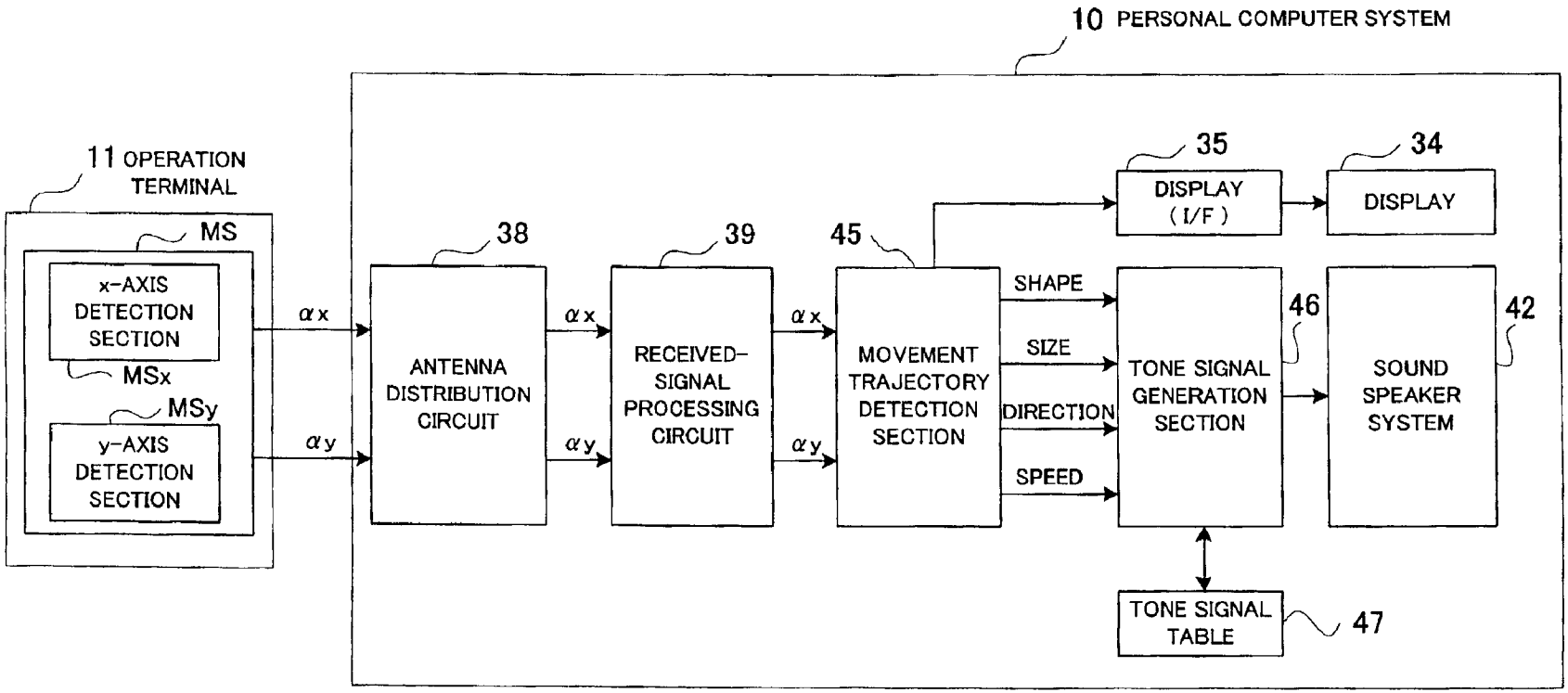
FIG. 4 is a block diagram showing an exemplary general setup and functions of the tone signal generation system of FIG. 1.

As seen in FIG. 4, the personal computer system 10 performs the tone generation process using the functions of the antenna distribution circuit 38, received-signal processing circuit 39, movement trajectory detection section 45, tone signal generation section 46, tone signal table 47, display device 34, display interface 35 and sound speaker system 42.

The antenna distribution circuit 38 receives detection signals of the x-axis and y-axis detection sections MSx and MSy, i.e. acceleration x in the x-axis direction and acceleration y in the y-axis direction, transmitted wirelessly from the operation terminal 11 moved by the human operator, and then supplies the received signals to the received-signal processing circuit 39.

The received-signal processing circuit 39 of FIG. 3 passes the signals indicative of the detected acceleration in the x- and y-axis directions, supplied via the antenna distribution circuit 38, through a predetermined band-pass filter section so as to remove frequency components unnecessary for detection, by the movement trajectory detection section 45, of a movement trajectory (i.e., path of movement) of the operation terminal 11. The received-signal processing circuit 39 also removes acceleration components produced by the terrestrial gravity. Then, the received-signal processing circuit 39 outputs the signals indicative of the acceleration x and y, having the unnecessary frequency components removed therefrom, to the movement trajectory detection section 45.

The movement trajectory detection section 45 detects a movement trajectory (path of movement) of the operation terminal 11 on the basis of the acceleration x in the x-axis direction and acceleration y in the x-axis direction supplied from the received-signal processing circuit 39. More specifically, at a time point when the supplied acceleration values x and y have become greater than a predetermined small threshold value corresponding to a virtually stationary state of the operation terminal 11, the movement trajectory detection section 45 judges that the movement of the operation terminal 11 has been started by the human operator, and starts detecting the movement trajectory of the operation terminal 11 on the basis of the supplied acceleration values x and y from this time point onward. Then, when the supplied acceleration values x and y have become smaller than the predetermined small threshold value during the course of the movement trajectory detection, the movement trajectory detection section 45 judges that the operation terminal 11 has been placed in the virtually stationary state, and then terminates the movement trajectory detection. In this way, the movement trajectory detection section 45 can detect any movement trajectory drawn by a succession of movements of the operation terminal 11 manipulated by the human operator. Although the time period for detecting the movement trajectory may be set on the basis of the supplied acceleration values x and y as noted above, there may be provided a separate switch or the like on or in association with the operation terminal 11 for designating a desired movement-trajectory detecting time period so that the movement trajectory detection section 45 detects a movement trajectory on the basis of the acceleration values x and y supplied while the switch is in a depressed or activated state. In this case, the human operator makes desired motions while depressing that switch only for a time period when the movement trajectory of the operation terminal 11 is to be detected.

Figures 5A, 5B:
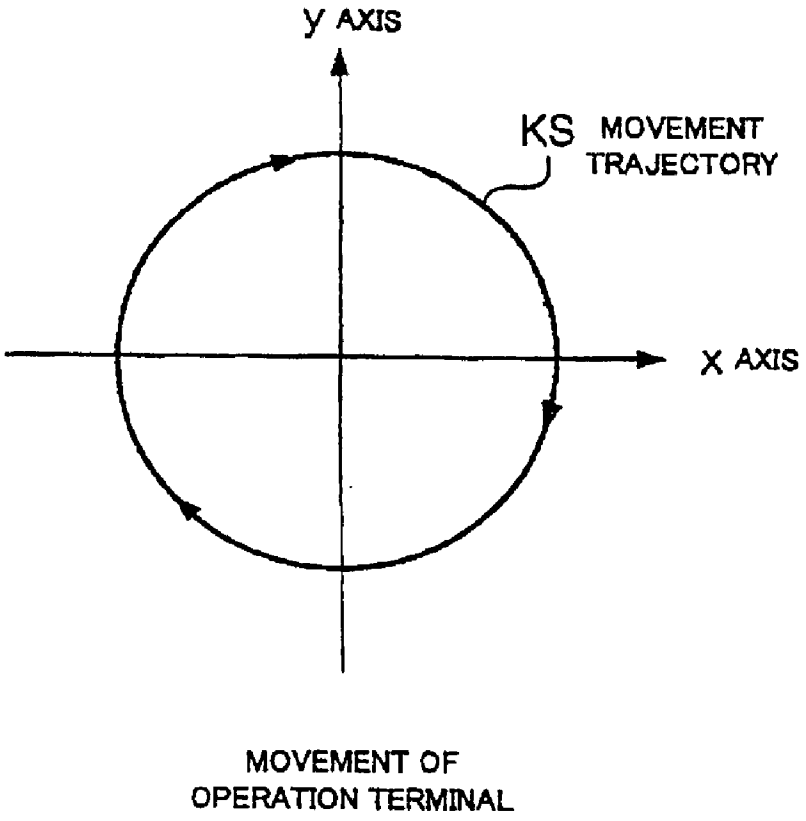
FIGS. 5A and 5B are diagrams showing an example of a movement trajectory of the operation terminal corresponding to a motion of a user or human operator and also explaining several items of information generated in accordance with the movement trajectory.
Figure 6A:
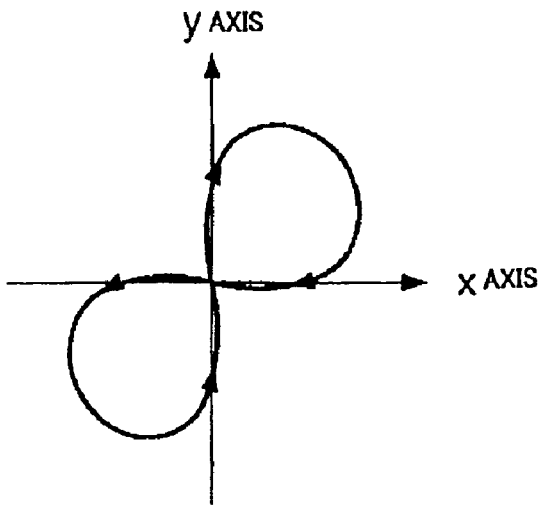
FIGS. 6A and 6D are diagrams showing several exemplary shapes of the movement trajectory drawn by the operation terminal.
Figure 6B:
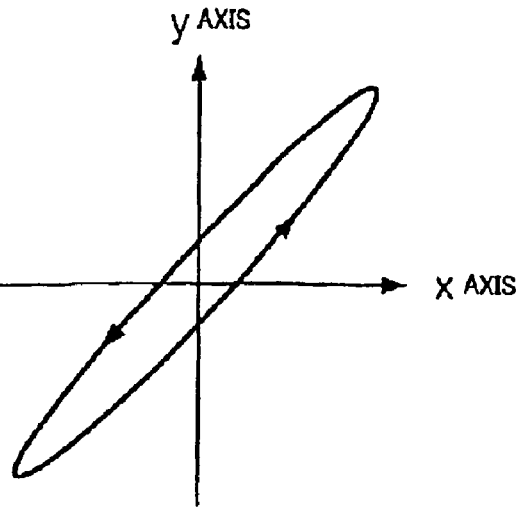
Figure 6C:
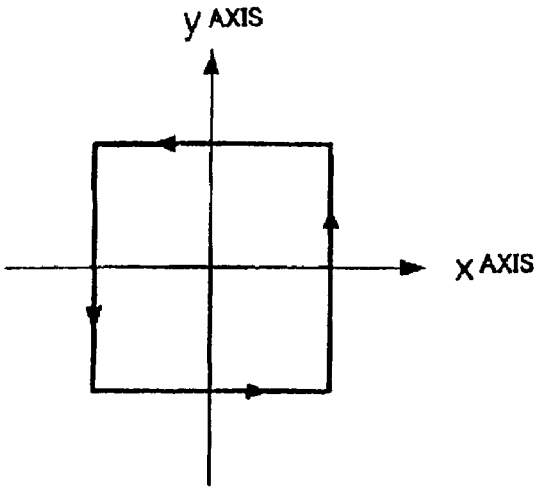
Figure 6D:
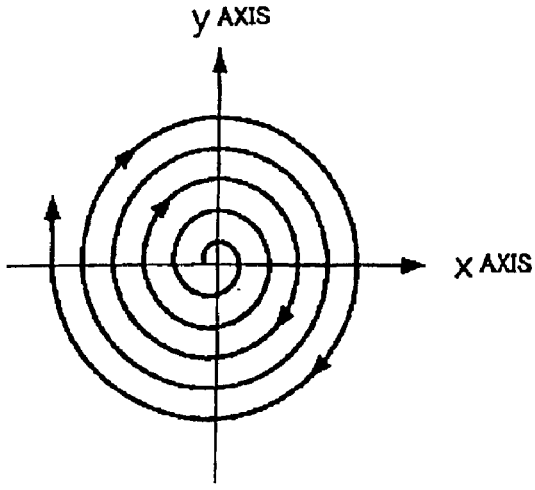

Namely, the movement trajectory detection section 45 provides information pertaining to a movement trajectory of the operation terminal 11 (i.e., movement trajectory information) on the basis of the acceleration values x and y supplied from the received-signal processing circuit 39 during the above-mentioned time period. Here, the "movement trajectory information" include items of information that are indicative of an approximate overall trajectory, size, moving direction, moving speed, etc. of the movement trajectory of the operation terminal in question. For example, when the human operator has moved the operation terminal 11 in a clockwise direction at a speed of "V" in such a manner to draw a circular trajectory shape representative of one revolution as shown in FIG. 5A, the movement trajectory detection section 45 provides movement trajectory information as shown in FIG. 5B. Namely, the movement trajectory detection section 45 generates information indicative of a "circular trajectory shape of one revolution" as the trajectory shape information, information indicative of a size (e.g., "radius R") of the circular trajectory shape as the size information, information indicative of "clockwise" as the moving direction information and information indicative of "V" as the moving speed information. The movement trajectory detection section 45 outputs the thus-generated items of the movement trajectory information to the tone signal generation section 46. Various other movement trajectory shapes than the "circular trajectory shape" are of course possible, and all of these possible or typical movement trajectory shapes are preferably registered in the later-described tone signal table 47. In such a case, the movement trajectory detection section 45 can detect, on the basis of the movement trajectory determined on the basis of the acceleration values x and y, a particular one of the registered movement trajectory shapes which the determined movement trajectory corresponds to or is similar to. The various other possible or typical movement trajectory shapes include, but are not limited to, a shape of numeral "8", elongated oval shape, obliquely-cut surface shape, rectangular shape and spiral shape, as illustratively shown in FIGS. 6A to 6D.

Here, for detection of a movement trajectory shape of the operation terminal 11 on the basis of acceleration values x and y supplied from the operation terminal 11, there may be employed a detection scheme in accordance with which a movement trajectory is detected for an entire section from the start to end of the movement on the basis of the supplied acceleration values x and y and then the movement trajectory shape is identified by determining which one of already-known shapes the detected movement trajectory corresponds to or matches. Other detection schemes may of course be employed; for example, a movement trajectory shape may be detected on the basis of the acceleration values x and y supplied from the operation terminal 11 in accordance with a procedure or step sequence flowcharted in FIGS. 7 and 8 using a trajectory shape recognizing table of FIG. 9 prestored in the movement trajectory detection section 45.

Figure 7:
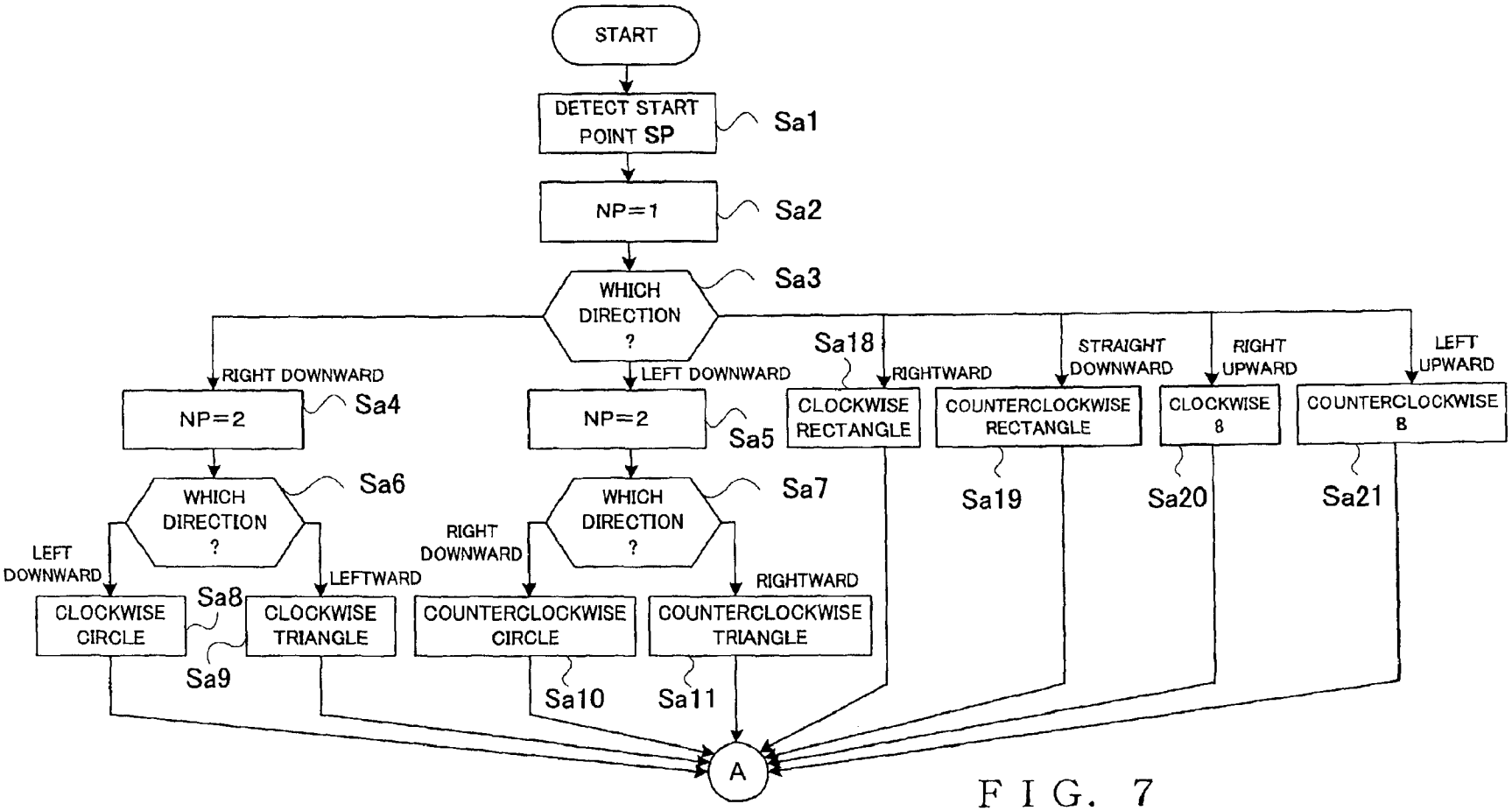
FIG. 7 is a flow chart showing part of a step sequence for detecting a movement trajectory of the operation terminal.
Figure 8:
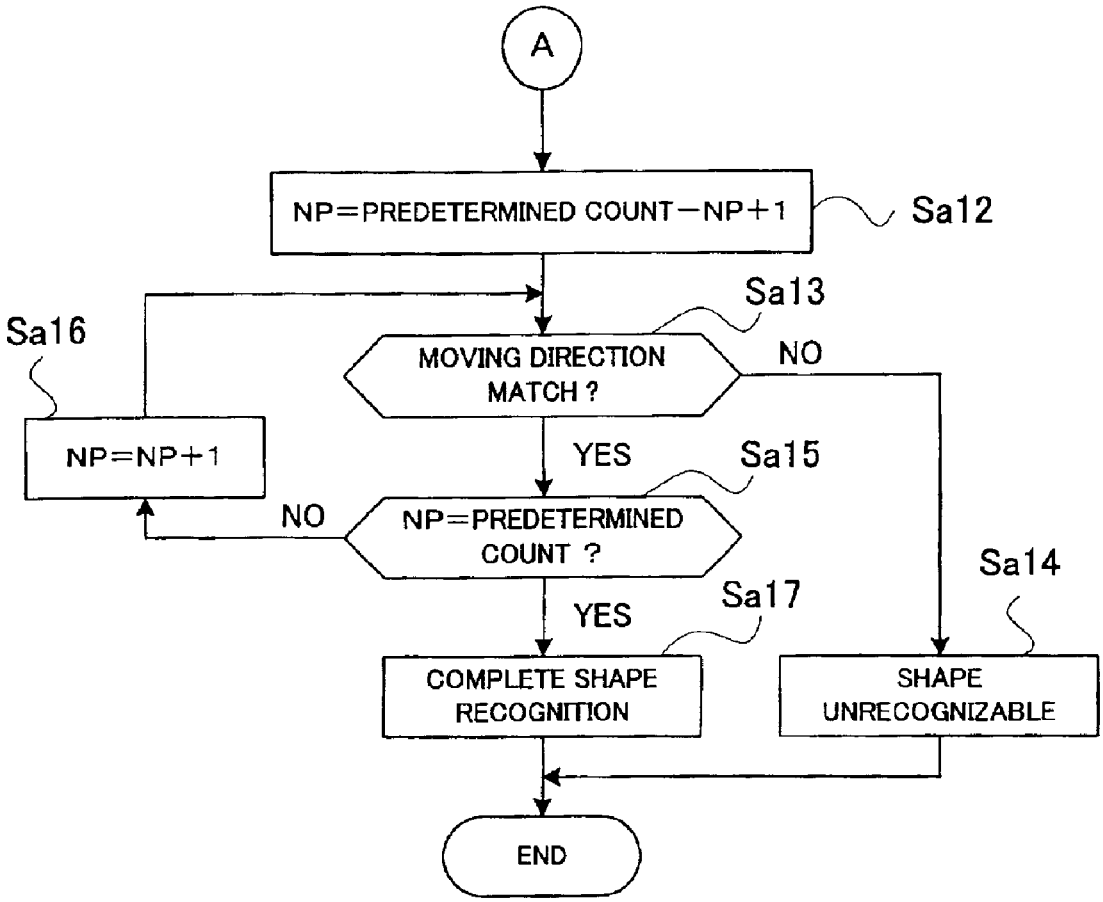
FIG. 8 is a flow chart showing the remaining part of the step sequence for detecting a movement trajectory of the operation terminal.
Figure 10:
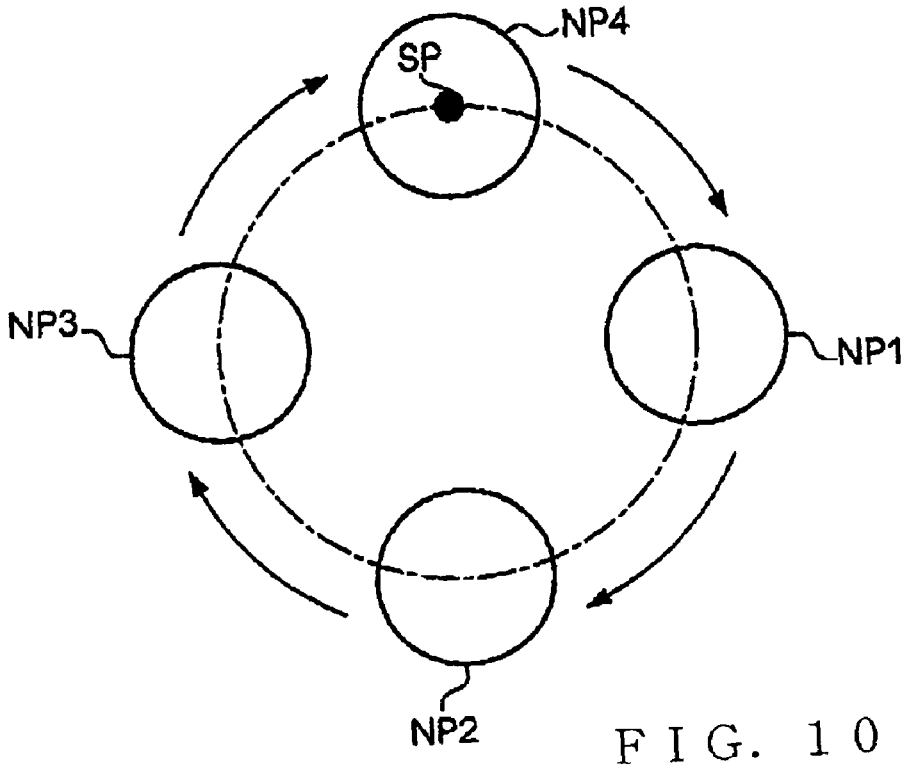
FIG. 10 is a diagram explanatory of a process for detecting a movement trajectory of the operation terminal.

Now, a description will be made about a movement trajectory detection process based on the procedure flowcharted in FIGS. 7 and 8, in relation to cases where the operation terminal 11 is moved in various trajectory shapes. First of all, the movement trajectory detection process is described below in relation to the case where the human operator moves the operation terminal 11 in a clockwise circular shape as illustrated in FIG. 10.

As the human operator moves the operation terminal 11, the movement trajectory detection section 45 detects, on the basis of acceleration values x and y supplied from the operation terminal 11, that the operation terminal 11 has started moving, i.e. a movement start point SP, at step Sa1. Also, a recognition-point count NP is set to "1" at step Sa2. Here, the recognition-point count NP is a count indicative of the number of recognition points designated for identifying a moving direction of the operation terminal 11 to thereby identify or recognize a movement trajectory shape of the operation terminal 11. The recognition-point count NP of "1" (NP=1) indicates a first recognition point NP1 from the movement start point SP, and the recognition-point count NP of "2" (NP=2) indicates a second recognition point NP2.

After that, the movement trajectory detection section 45 determines, at step Sa3, a moving direction in which the operation terminal 11 has moved from the movement start point SP to the first recognition point NP1. If the human operator has moved the operation terminal 11 in a clockwise circular shape, the moving direction of the operation terminal 11 from the movement start point SP to the first recognition point NP1 is "right downward" as illustrated in FIG. 10. Then, as the operation terminal 11 continues moving after the moving direction of the operation terminal 11 from the movement start point SP to the first recognition point NP1 has been detected in this way, the movement trajectory detection section 45 goes to step Sa4, where the recognition-point count NP is set to 2. Then, the movement trajectory detection section 45 determines, at step Sa6, a moving direction in which the operation terminal 11 has moved from the first recognition point NP1 to the second recognition point NP2.

In the case where the moving direction of the operation terminal 11 from the movement start point SP to the first recognition point NP1 has been identified, at step Sa3, as "right downward" as above and if the moving direction from the first recognition point NP1 to the second recognition point NP2 has been identified as "left downward", the movement trajectory detection section 45 determines that the operation terminal 11 is moving in a "clockwise circular shape" and then sets a corresponding "clockwise circular" trajectory shape flag at step Sa8.

Once the movement trajectory detection section 45 has determined that the operation terminal 11 is moving in a clockwise circular trajectory shape and has set the corresponding trajectory shape flag, the detection section 45 refers to a trajectory shape recognizing table of FIG. 9 to perform operations for ascertaining whether the operation terminal 11 is actually moving in the thus-determined trajectory shape.

Before going to a detailed description of such ascertaining operations, specific stored contents of the trajectory shape recognizing table of FIG. 9 are described here. As shown, the shape recognizing table has stored therein predetermined counts and moving directions corresponding to recognition points NP1, NP2, . . . , in association with various trajectory shapes identifiable by the movement trajectory detection section 45, such as "clockwise circle", "counterclockwise circle", "clockwise rectangle", "counterclockwise rectangle", "clockwise triangle", "counterclockwise triangle", "clockwise (or right-handed) 8" and "counterclockwise (or left-handed) 8". Here, each of the "moving directions corresponding to recognition points" represents a moving direction from an immediately preceding recognition point; in the case of the first recognition point NP1, the moving direction is a direction from the movement start point SP to the first recognition point NP1. In the shape recognizing table illustrated in FIG. 9, "right downward" stored as the moving direction corresponding to the first recognition point NP1 for the trajectory shape "clockwise circle" indicates that a condition essential for identifying a "clockwise circular" movement trajectory as regards an initial section from the movement start point SP to the first recognition point NP1 is "right downward". For each of the following recognition points NP2, NP3, . . . , a moving direction from the immediately preceding recognition point is stored in the table. "left downward" stored as the moving direction corresponding to the second recognition point NP2 for the trajectory shape "clockwise circle" indicates that a condition essential for identifying a "clockwise circular" movement trajectory as regards a second section from the first recognition point NP1 to the second recognition point NP2 is "left downward".

Further, in the trajectory shape recognizing table, the "predetermined count" is indicative of the total number of the recognition points to be passed by the operation terminal 11 required for the movement trajectory shape recognition. Regarding the trajectory shape "clockwise circle", "4" is stored as the predetermined count, which indicates that it has to be ascertained whether or not the operation terminal 11 has passed four recognition points in total before completion of the process for recognizing the "clockwise circular" movement trajectory. Thus, for this "clockwise circular" movement trajectory shape, moving directions corresponding to the four recognition points NP1–NP4 are stored in the trajectory shape recognizing table. Similarly, a numerical value "8" is stored as the predetermined count corresponding to the trajectory shape "clockwise 8", which indicates that it has to be ascertained whether or not the operation terminal 11 has passed eight recognition points in total before completion of the process for identifying the "clockwise 8" movement trajectory.

With reference to the shape recognizing table of FIG. 9 containing such data, the movement trajectory detection section 45 performs the operations for ascertaining whether the operation terminal 11 is actually moving in the trajectory shape for which the trajectory shape flag has been set.

First, when the "clockwise circular" trajectory shape flag has been set at step Sa8 in the above-described manner, the movement trajectory detection section 45 subtracts the current recognition point count NP from the predetermined count corresponding to the set trajectory shape flag, and sets a value obtained, by incrementing the subtraction result by one, as a next recognition point count NP at step Sa12. Specifically, in this case, the recognition point count NP is "2" and the predetermined count corresponding to the "clockwise circular" trajectory shape is "4", so that the movement trajectory detection section 45 sets "3" as the next recognition point count NP (i.e., 4−2+1=3). After that, the movement trajectory detection section 45 determines, at step Sa13, whether the moving direction of the operation terminal 11 from the recognition point NP2 to the next recognition point count NP3 matches the "left upward" direction corresponding to "NP3" for the "clockwise circle" stored in the recognizing table. If the two directions match as determined at step Sa13, it is ascertained that the operation terminal 11 is actually moving in the trajectory shape "clockwise circle" indicated by the set trajectory shape flag. In case the two directions fail to match, it is determined that the operation terminal 11 is not moving in the trajectory shape "clockwise circle".

After having determined that the operation terminal 11 is not moving in the trajectory shape "clockwise circle" (NO determination at step Sa13), the movement trajectory detection section 45 judges that the trajectory shape is unrecognizable at step Sa14, and resets the set trajectory shape flag.

If, on the other hand, it is ascertained that the operation terminal 11 is actually moving in the trajectory shape "clockwise circle" (YES determination at step Sa13), the movement trajectory detection section 45 further determines, at step Sa15, whether the current recognition point count NP (at this point, NP3) has coincided with the predetermined count (=4) stored in the trajectory shape recognizing table, i.e. whether the moving direction has been checked at the necessary number of the recognition points for recognizing the shape indicated by the set trajectory shape flag. If the current recognition point count NP (at this point, NP3) has not coincided with the predetermined count, i.e. if the moving direction has not yet been checked at all of the necessary number of the recognition points, the recognition point count NP is incremented by one at step Sa16; namely, in this case, the recognition point count NP is set to "4". Then, the movement trajectory detection section 45 reverts to step Sa13 in order to check the moving direction for the fourth recognition point 4 corresponding to the newly-set recognition point count NP. Specifically, the movement trajectory detection section 45 determines, at step Sa13, whether the moving direction of the operation terminal 11 from the recognition point NP3 to the next recognition point count NP4 matches the "right upward" direction corresponding to "NP4" stored in the recognizing table. If the two directions match as determined at step Sa13, it is ascertained that the operation terminal 11 is actually moving in the trajectory shape "clockwise circle" indicated by the set trajectory shape flat. In case the two directions fail to match, it is determined that the operation terminal 11 is not moving in the trajectory shape "clockwise circle".

After having determined that the operation terminal 11 is not moving in the trajectory shape "clockwise circle" (NO determination at step Sa13), the movement trajectory detection section 45 judges that the trajectory shape is unrecognizable at step Sa14, and resets the set trajectory shape flag. If, on the other hand, it is ascertained that the operation terminal 11 is actually moving in the trajectory shape "clockwise circle" (YES determination at step Sa13), the movement trajectory detection section 45 further determines, at step Sa15, whether the current recognition point count NP (at this point, NP4) has coincided with the predetermined count (=4) stored in the recognizing table. Because an YES determination is made at step Sa15 at this stage, the movement trajectory detection section 45 reverts to step Sa17, where the detection section 45 judges that the operation terminal 11 has fully moved in the trajectory shape "clockwise circle" indicated by the set trajectory shape flag and then terminates the movement-trajectory-shape recognition process. Upon completion of the movement-trajectory-shape recognition process, tone control and the like are performed, in accordance with the thus-recognized movement trajectory shape, in a later-described manner.

Figure 11:
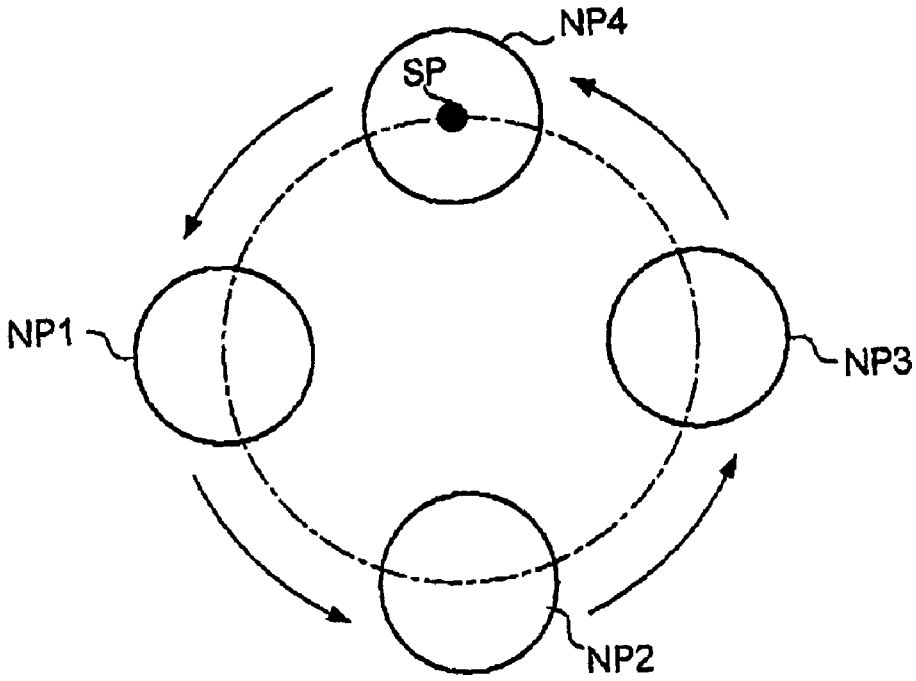
FIG. 11 is a diagram explanatory of a process for detecting another movement trajectory of the operation terminal.

Next, the movement trajectory detection process is described in relation to the case where the human operator moves the operation terminal 11 in a counterclockwise circular shape as illustrated in FIG. 11. As the human operator moves the operation terminal 11, the movement trajectory detection section 45 detects, on the basis of acceleration values x and y supplied from the operation terminal 11, that the operation terminal 11 has started moving, i.e. a movement start point SP, at step Sa1. Also, the recognition-point count NP is set to "1" at step Sa2.

After that, the movement trajectory detection section 45 determines, at step Sa3, a moving direction in which the operation terminal 11 has moved from the movement start point SP to the first recognition point NP1. If the human operator has moved the operation terminal 11 in a counterclockwise circular shape, the moving direction of the operation terminal 11 from the movement start point SP to the first recognition point NP1 is "left downward" as illustrated in FIG. 11. Thus, the movement trajectory detection section 45 goes to step Sa5, where the recognition-point count NP is set to "2". Then, the movement trajectory detection section 45 determines, at step Sa7, a moving direction in which the operation terminal 11 has moved from the first recognition point NP1 to the second recognition point NP2.

In the case where the moving direction of the operation terminal 11 from the movement start point SP to the first recognition point NP1 has been identified, at step Sa3, as "left downward" and if the moving direction from the first recognition point NP1 to the second recognition point NP2 has been identified as "right downward", the movement trajectory detection section 45 determines that the operation terminal 11 is moving in a "counterclockwise circular shape" and then sets a corresponding "counterclockwise circular" trajectory shape flag at step Sa10.

Once the movement trajectory detection section 45 has determined that the operation terminal 11 is moving in a counterclockwise circular trajectory shape and has set the corresponding trajectory shape flag as above, the section 45 refers to the trajectory shape recognizing table of FIG. 9 to perform operations for ascertaining whether the operation terminal 11 is actually moving in the thus-determined trajectory shape. Namely, the movement trajectory detection section 45 carries out the ascertaining operations, in accordance with a similar procedure to the above-described ascertaining operations for the "clockwise circular" trajectory shape (steps Sa12 to Sa17), using the data of the "predetermined count" and the recognition points "NP1" to "NP4" stored in the shape recognizing table for the trajectory shape "counterclockwise circle". Thus, when the human operator has moved the operation terminal 11 in the manner as shown in FIG. 11, the movement trajectory detection section 45 judges that the movement trajectory is of the "counterclockwise circular" shape, and tone control and the like are performed, in accordance with the thus-recognized movement trajectory shape "counterclockwise circle".

Figure 12:
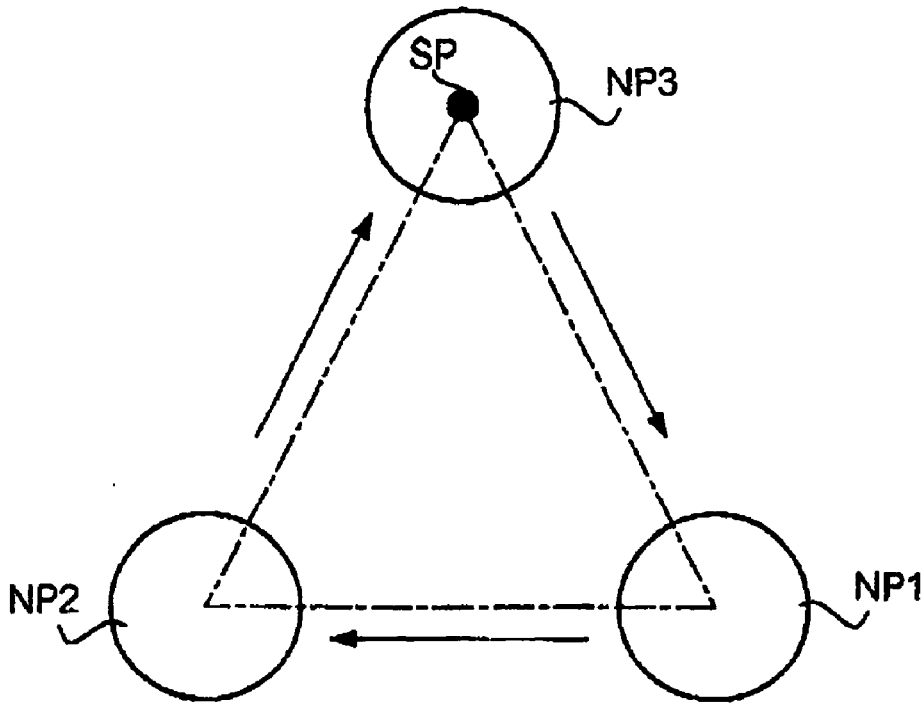
FIG. 12 is a diagram explanatory of a process for detecting still another movement trajectory of the operation terminal.

Next, the movement trajectory detection process is described in relation to the case where the human operator moves the operation terminal 11 in a clockwise triangular shape as illustrated in FIG. 12. As the human operator moves the operation terminal 11, the movement trajectory detection section 45 detects, on the basis of acceleration values x and y supplied from the operation terminal 11, that the operation terminal 11 has started moving, i.e. a movement start point SP, at step Sa1. Also, the recognition-point count NP is set to "1" at step Sa2.

After that, the movement trajectory detection section 45 determines, at step Sa3, a moving direction in which the operation terminal 11 has moved from the movement start point SP to the first recognition point NP1. If the human operator has moved the operation terminal 11 in a clockwise triangular shape, the moving direction of the operation terminal 11 from the movement start point SP to the first recognition point NP1 is "right downward" as illustrated in FIG. 12. Thus, the movement trajectory detection section 45 goes to step Sa4, where the recognition-point count NP is set to "2". Then, the movement trajectory detection section 45 determines, at step Sa6, a moving direction in which the operation terminal 11 has moved from the first recognition point NP1 to the second recognition point NP2.

In the case where the moving direction of the operation terminal 11 from the movement start point SP to the first recognition point NP1 has been identified, at step Sa3, as "right downward" and if the moving direction from the first recognition point NP1 to the second recognition point NP2 has been identified as "leftward", then the movement trajectory detection section 45 determines that the operation terminal 11 is moving in a "clockwise triangular shape" and then sets a corresponding "clockwise triangular" trajectory shape flag at step Sa9.

Once the movement trajectory detection section 45 has determined that the operation terminal 11 is moving in a clockwise triangular shape and has set the corresponding trajectory shape flag as above, the section 45 refers to the trajectory shape recognizing table of FIG. 9 to perform operations for ascertaining whether the operation terminal 11 is actually moving in the thus-determined trajectory shape. Namely, the movement trajectory detection section 45 carries out the ascertaining operations, in accordance with a similar procedure to the above-described ascertaining operations for the "clockwise circular" trajectory shape (steps Sa12 to Sa17), using the data of the "predetermined count" and the recognition points "NP1" to "NP3" stored in the shape recognizing table for the trajectory shape "clockwise triangle". Thus, when the human operator has moved the operation terminal 11 in the manner as shown in FIG. 12, the movement trajectory detection section 45 judges that the movement trajectory is of the "clockwise triangular" shape, and tone control and the like are performed, in accordance with the thus-recognized movement trajectory shape "clockwise triangle".

Figure 13:
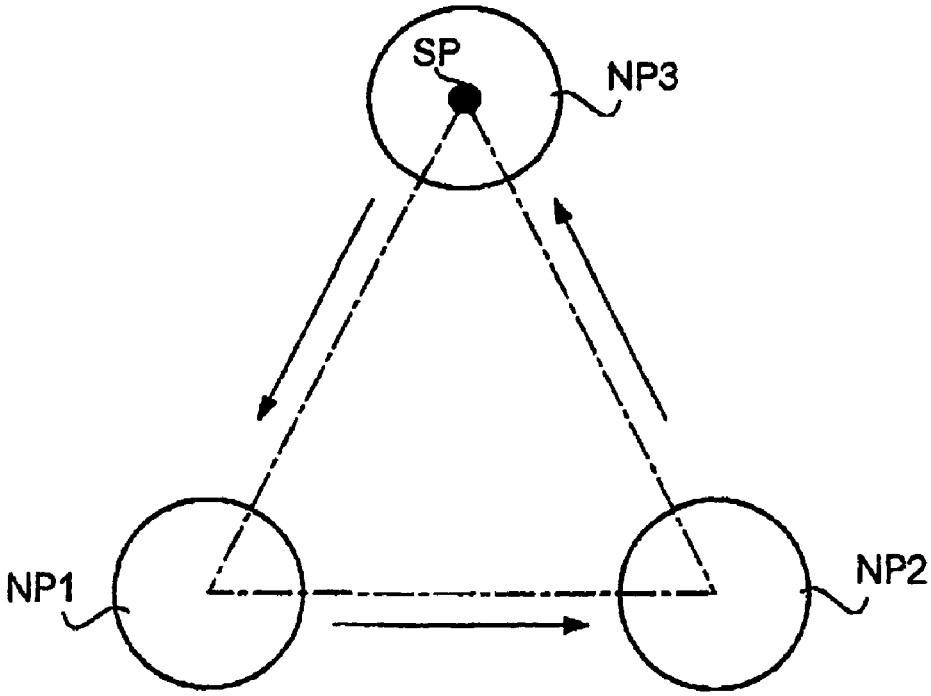
FIG. 13 is a diagram explanatory of a process for detecting still another movement trajectory of the operation terminal.

Next, the movement trajectory detection process is described in relation to the case where the human operator moves the operation terminal 11 in a counterclockwise triangular shape as illustrated in FIG. 13. As the human operator moves the operation terminal 11, the movement trajectory detection section 45 detects, on the basis of acceleration values x and y supplied from the operation terminal 11, that the operation terminal 11 has started moving, i.e. a movement start point SP, at step Sa1. Also, the recognition-point count NP is set to "1" at step Sa2.

Then, the movement trajectory detection section 45 determines, at step Sa3, a moving direction in which the operation terminal 11 has moved from the movement start point SP to the first recognition point NP1. If the human operator has moved the operation terminal 11 in a counterclockwise triangular shape, the moving direction of the operation terminal 11 from the movement start point SP to the first recognition point NP1 is "left downward" as illustrated in FIG. 13. Thus, the movement trajectory detection section 45 goes to step Sa5, where the recognition-point count NP is set to "2". Then, the movement trajectory detection section 45 determines, at step Sa6, a moving direction in which the operation terminal 11 has moved from the first recognition point NP1 to the second recognition point NP2.

In the case where the moving direction of the operation terminal 11 from the movement start point SP to the first recognition point NP1 has been identified, at step Sa3, as "left downward" and if the moving direction from the first recognition point NP1 to the second recognition point NP2 has been identified as "rightward", the movement trajectory detection section 45 determines that the operation terminal 11 is moving in a "counterclockwise triangular shape" and then sets a corresponding "counterclockwise triangular" trajectory shape flag at step Sa9.

Once the movement trajectory detection section 45 has determined that the operation terminal 11 is moving in a counterclockwise triangular shape and has set the corresponding trajectory shape flag as above, the section 45 refers to the trajectory shape recognizing table of FIG. 9 to perform operations for ascertaining whether the operation terminal 11 is actually moving in the thus-determined trajectory shape. Namely, the movement trajectory detection section 45 carries out the ascertaining operations, in accordance with a similar procedure to the above-described ascertaining operations for the "clockwise circular" trajectory shape (steps Sa12 to Sa17), using the data of the "predetermined count" and the recognition points "NP1" to "NP3" stored in the shape recognizing table for the trajectory shape "counterclockwise triangle". Thus, when the human operator has moved the operation terminal 11 in the manner as shown in FIG. 13, the movement trajectory detection section 45 judges that the movement trajectory is of the "counterclockwise triangular" shape, and tone control and the like are performed, in accordance with the thus-recognized movement trajectory shape "counterclockwise triangle".

Figure 14:
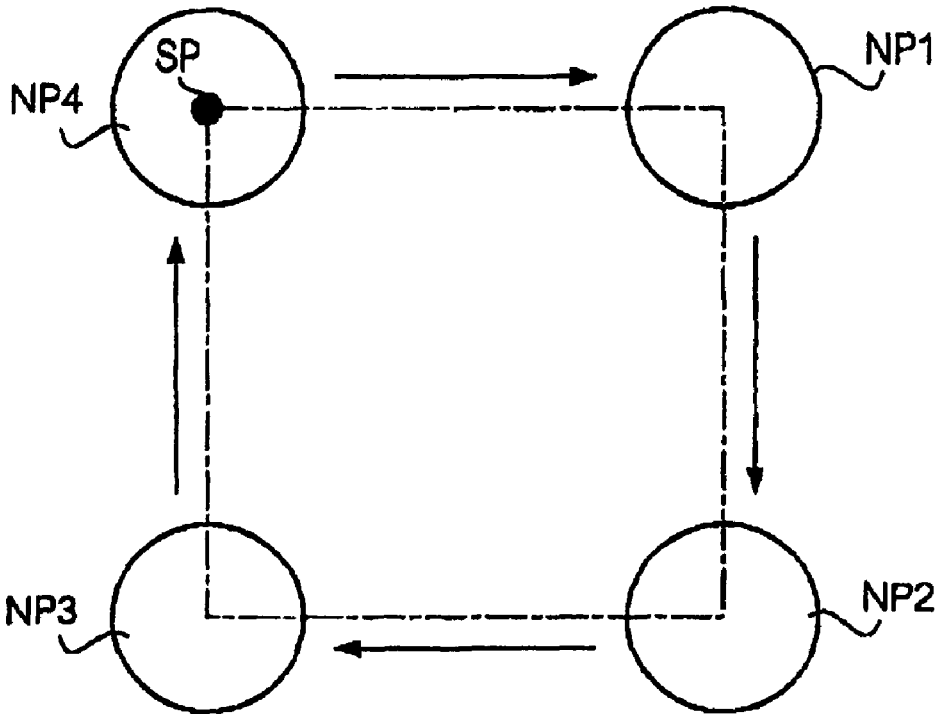
FIG. 14 is a diagram explanatory of a process for detecting still another movement trajectory of the operation terminal.

Next, the movement trajectory detection process is described in relation to the case where the human operator moves the operation terminal 11 in a clockwise rectangular shape as illustrated in FIG. 14. As the human operator moves the operation terminal 11, the movement trajectory detection section 45 detects, on the basis of acceleration values x and y supplied from the operation terminal 11, that the operation terminal 11 has started moving, i.e. a movement start point SP, at step Sa1. Also, the recognition-point count NP is set to "1" at step Sa2.

Then, the movement trajectory detection section 45 determines, at step Sa3, a moving direction in which the operation terminal 11 has moved from the movement start point SP to the first recognition point NP1. If the human operator has moved the operation terminal 11 in a clockwise rectangular shape, the moving direction of the operation terminal 11 from the movement start point SP to the first recognition point NP1 is "rightward" as illustrated in FIG. 14. Thus, the movement trajectory detection section 45 goes to step Sa18, where the movement trajectory detection section 45 determines that the operation terminal 11 is moving in a "clockwise rectangular shape" and then sets a corresponding "clockwise rectangular" trajectory shape flag.

Once the movement trajectory detection section 45 has determined that the operation terminal 11 is moving in a clockwise rectangular shape and has set the corresponding trajectory shape flag as above, the section 45 refers to the trajectory shape recognizing table of FIG. 9 to perform operations for ascertaining whether the operation terminal 11 is actually moving in the thus-determined trajectory shape. Namely, the movement trajectory detection section 45 carries out the ascertaining operations, in accordance with a similar procedure to the above-described ascertaining operations for the "clockwise circular" trajectory shape (steps Sa12 to Sa17), using the data of the "predetermined count" and the recognition points "NP1" to "NP4" stored in the shape recognizing table for the trajectory shape "clockwise rectangle". Thus, when the human operator has moved the operation terminal 11 in the manner as shown in FIG. 14, the movement trajectory detection section 45 judges that the movement trajectory is of the "clockwise rectangular" shape, and tone control and the like are performed, in accordance with the thus-recognized movement trajectory shape "clockwise rectangle".

Figure 15:
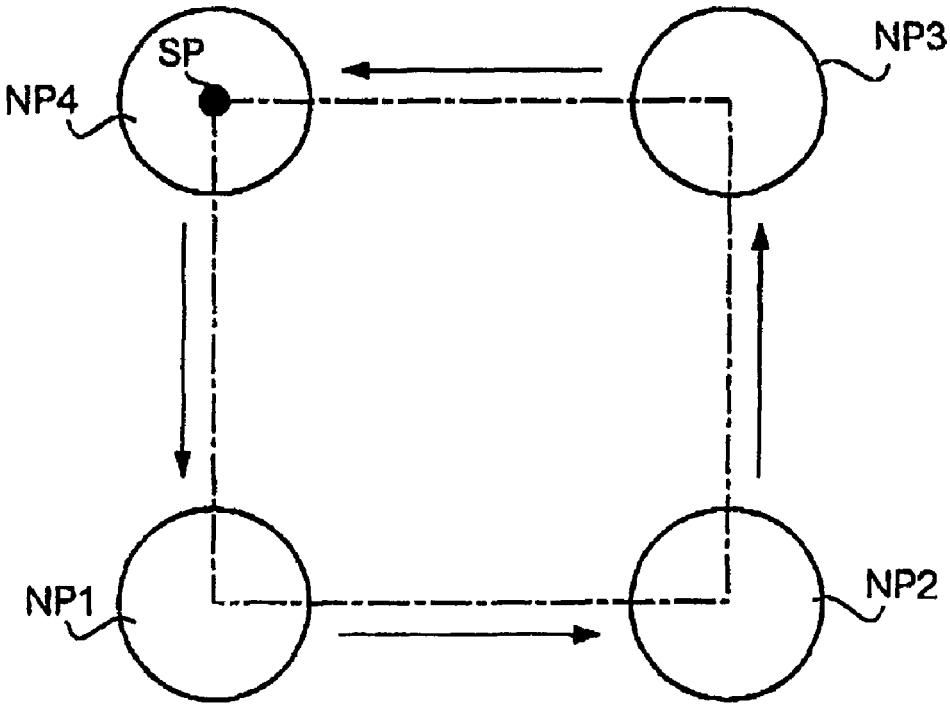
FIG. 15 is a diagram explanatory of a process for detecting still another movement trajectory of the operation terminal.

Next, the movement trajectory detection process is described in relation to the case where the human operator moves the operation terminal 11 in a counterclockwise rectangular shape as illustrated in FIG. 15. As the human operator moves the operation terminal 11, the movement trajectory detection section 45 detects, on the basis of acceleration values x and y supplied from the operation terminal 11, that the operation terminal 11 has started moving, i.e. a movement start point SP, at step Sa1. Also, the recognition-point count NP is set to "1" at step Sa2.

Then, the movement trajectory detection section 45 determines, at step Sa3, a moving direction in which the operation terminal 11 has moved from the movement start point SP to the first recognition point NP1. If the human operator has moved the operation terminal 11 in a counterclockwise rectangular shape, the moving direction of the operation terminal 11 from the movement start point SP to the first recognition point NP1 is substantially "straight downward" as illustrated in FIG. 15. Thus, the movement trajectory detection section 45 goes to step Sa19, where the movement trajectory detection section 45 determines that the operation terminal 11 is moving in a "counterclockwise rectangular shape" and then sets a corresponding "counterclockwise rectangular" trajectory shape flag.

Once the movement trajectory detection section 45 has determined that the operation terminal 11 is moving in a counterclockwise rectangular shape and has set the corresponding trajectory shape flag as above, the detection section 45 refers to the trajectory shape recognizing table of FIG. 9 to perform operations for ascertaining whether the operation terminal 11 is actually moving in the thus-determined trajectory shape. Namely, the movement trajectory detection section 45 carries out the ascertaining operations, in accordance with a similar procedure to the above-described ascertaining operations for the "clockwise circular" trajectory shape (steps Sa12 to Sa17), using the data of the "predetermined count" and the recognition points "NP1" to "NP4" stored in the shape recognizing table for the trajectory shape "counterclockwise rectangle". Thus, when the human operator has moved the operation terminal 11 in the manner as shown in FIG. 15, the movement trajectory detection section 45 judges that the movement trajectory is of the "counterclockwise rectangular" shape, and tone control and the like are performed, in accordance with the thus-recognized movement trajectory shape "counterclockwise rectangle".

Figure 16:
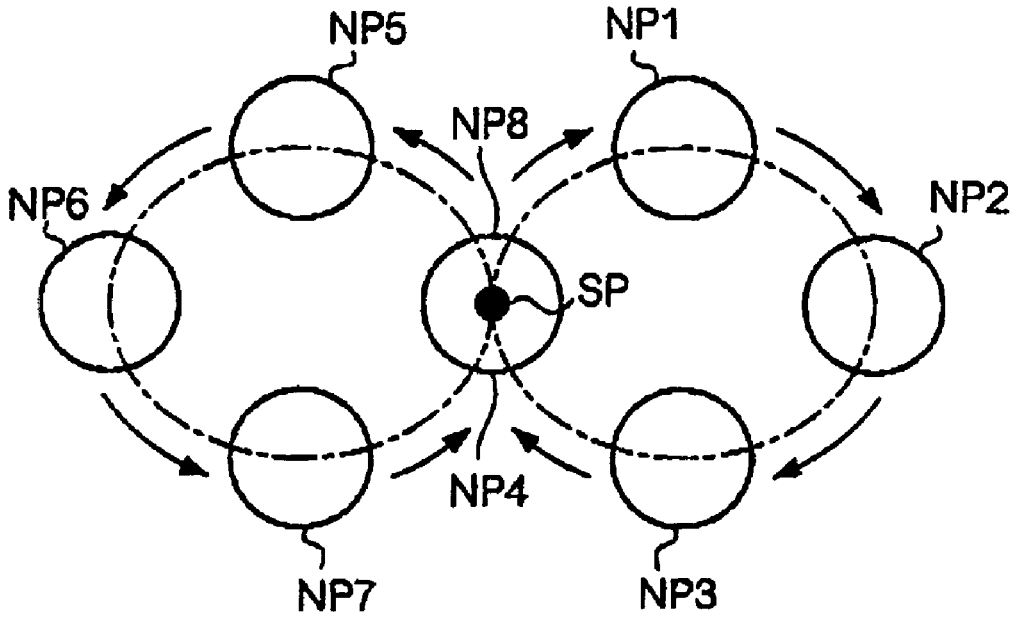
FIG. 16 is a diagram explanatory of a process for detecting still another movement trajectory of the operation terminal.

Next, the movement trajectory detection process is described in relation to the case where the human operator moves the operation terminal 11 in a "clockwise 8" shape as illustrated in FIG. 16. As the human operator moves the operation terminal 11, the movement trajectory detection section 45 detects, on the basis of acceleration values x and y supplied from the operation terminal 11, that the operation terminal 11 has started moving, i.e. a movement start point SP, at step Sa1. Also, the recognition-point count NP is set to "1" at step Sa2.

Then, the movement trajectory detection section 45 determines, at step Sa3, a moving direction in which the operation terminal 11 has moved from the movement start point SP to the first recognition point NP1. If the human operator has moved the operation terminal 11 in a clockwise 8 shape, the moving direction of the operation terminal 11 from the detected movement start point SP to the first recognition point NP1 is "right upward" as illustrated in FIG. 16. Thus, the movement trajectory detection section 45 goes to step Sa20, where the movement trajectory detection section 45 determines that the operation terminal 11 is moving in a "clockwise 8 shape" and then sets a corresponding "clockwise 8" trajectory shape flag.

Once the movement trajectory detection section 45 has determined that the operation terminal 11 is moving in a clockwise 8 shape and has set the corresponding trajectory shape flag as above, the section 45 refers to the trajectory shape recognizing table of FIG. 9 to perform operations for ascertaining whether the operation terminal 11 is actually moving in the thus-determined trajectory shape. Namely, the movement trajectory detection section 45 carries out the ascertaining operations, in accordance with a similar procedure to the above-described ascertaining operations for the "clockwise circular" trajectory shape (steps Sa12 to Sa17), using the data of the "predetermined count" and the recognition points "NP1" to "NP8" stored in the shape recognizing table for the trajectory shape "clockwise 8". More specifically, after the corresponding trajectory shape flag has been set, it is ascertained whether or not the operation terminal 11 is moving "right downward", "left downward", "left upward", . . . , "right downward" and "right upward" sequentially in the mentioned order. Thus, when the human operator has moved the operation terminal 11 in the manner as shown in FIG. 16, the movement trajectory detection section 45 judges that the movement trajectory is of the "clockwise 8" shape, and tone control and the like are performed, in accordance with the thus-recognized movement trajectory shape "clockwise 8".

Figure 17:
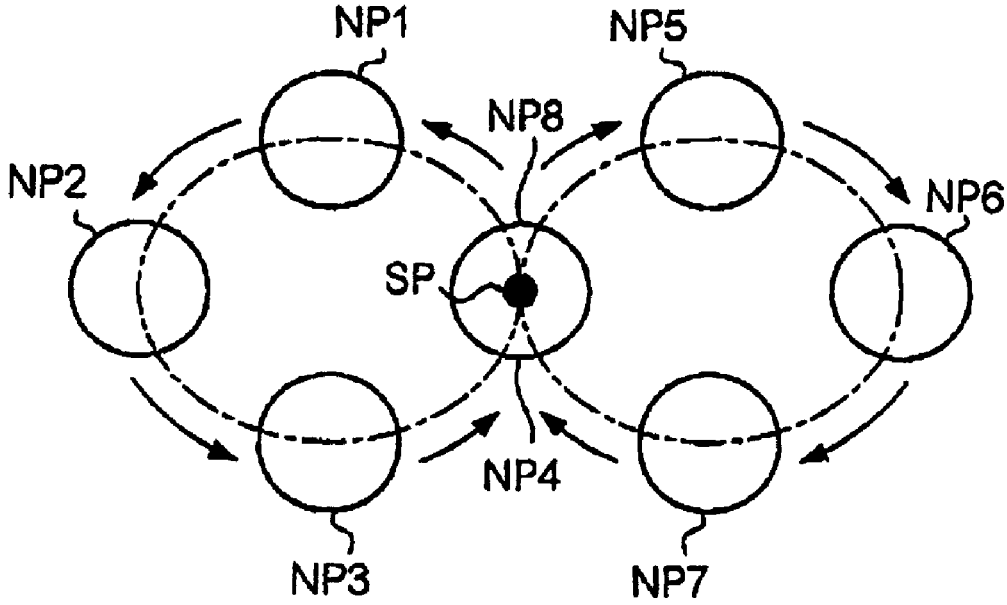
FIG. 17 is a diagram explanatory of a process for detecting still another movement trajectory of the operation terminal.

Finally, the movement trajectory detection process is described in relation to the case where the human operator moves the operation terminal 11 in a "counterclockwise 8" shape as illustrated in FIG. 17. As the human operator moves the operation terminal 11, the movement trajectory detection section 45 detects, on the basis of acceleration values x and y supplied from the operation terminal 11, that the operation terminal 11 has started moving, i.e. a movement start point SP, at step Sa1. Also, the recognition-point count NP is set to "1" at step Sa2.

Then, the movement trajectory detection section 45 determines, at step Sa3, a moving direction in which the operation terminal 11 has moved from the movement start point SP to the first recognition point NP1. If the human operator has moved the operation terminal 11 in a counterclockwise 8 shape, the moving direction of the operation terminal 11 from the detected movement start point SP to the first recognition point NP1 is "straight downward" as illustrated in FIG. 17. Thus, the movement trajectory detection section 45 goes to step Sa21, where the movement trajectory detection section 45 determines that the operation terminal 11 is moving in a "counterclockwise 8 shape" and then sets a "counterclockwise 8" trajectory shape flag.

Once the movement trajectory detection section 45 has determined that the operation terminal 11 is moving in a counterclockwise 8 shape and has set the corresponding trajectory shape flag as above, the section 45 refers to the trajectory shape recognizing table of FIG. 9 to perform operations for ascertaining whether the operation terminal 11 is actually moving in the thus-determined trajectory shape. Namely, the movement trajectory detection section 45 carries out the ascertaining operations, in accordance with a similar procedure to the above-described ascertaining operations for the "clockwise circular" trajectory shape (steps Sa12 to Sa17), using the data of the "predetermined count" and the recognition points "NP1" to "NP8" stored in the shape recognizing table for the trajectory shape "counterclockwise 8". More specifically, after the corresponding trajectory shape flag has been set, it is ascertained whether or not the operation terminal 11 is moving "left downward", "right downward", "right upward", . . . , "left downward" and "left upward" sequentially in the mentioned order. Thus, when the human operator has moved the operation terminal 11 in the manner as shown in FIG. 17, the movement trajectory detection section 45 judges that the movement trajectory is of the "counterclockwise 8" shape, and tone control and the like are performed, in accordance with the thus-recognized movement trajectory shape "counterclockwise 8".

The foregoing paragraphs have described various examples of procedures by which the movement trajectory detection section 45 detects various movement trajectories of the operation terminal 11. It should, however, be appreciated that the movement trajectory detection section 45 is capable of identifying movement trajectories of other shapes, such as a wave shape and mountain shape, by prestoring, in the shape recognizing table of FIG. 9, information necessary for recognizing such shapes; namely, in this case, it is only necessary that the shape recognizing table and the above-described procedures be modified appropriately.

Namely, the movement trajectory detection section 45 generates information pertaining to a movement trajectory drawn by a succession of movements of the operation terminal 11 and outputs the thus-generated movement trajectory information to the tone signal generation section 46. In addition, the movement trajectory detection section 45 sequentially calculates coordinates (x and y coordinates) information of the movement trajectory on the basis of the acceleration values x and y sequentially supplied from the received-signal processing circuit 39, and then outputs the thus-calculated coordinates information to the display interface 35. This way, the sequentially-changing movement trajectory of the operation terminal 11 (see FIG. 5A) is sequentially displayed on the display device 34. Thus, the human operator can ascertain in real time in which trajectory the operation terminal 11 is moving, by just viewing displayed contents on the display device 34 of the personal computer system 10. The human operator is also allowed to move the operation terminal 11 to draw a desired movement trajectory while viewing the displayed contents on the display device 34.

Further, by referring to the tone generation table 47, the tone signal generation section 46 generates tone signals on the basis of the various items of the movement trajectory information having been generated by the movement trajectory detection section 45 in the above-described manner. In the tone generation table 47, there are registered tone generating parameters for each of a plurality of items such as "Shape of Movement Trajectory (Moving Direction Included)", "Size of Movement Trajectory" and "Moving Speed", as seen in FIG. 18. In FIG. 18, parameters indicative of various tone colors are registered in relation to the item "Shape of Movement Trajectory (Moving Direction Included)". For example, a "piano" tone color is registered for a circular trajectory shape of one clockwise revolution, and a "wind" tone color, which is a natural sound, is registered for a circular trajectory shape of one counterclockwise revolution. Further, parameters indicative of tone volumes are registered in relation to the item "Size of Movement Trajectory"; in the illustrated example, three different tone volume parameters for "great", "medium" and "small" tone volumes are registered for "great", "medium" and "small" trajectory sizes, respectively. Furthermore, parameters indicative of scale notes are registered in relation to the item "Moving Speed"; in the illustrated example, different scale notes are registered for a plurality of predetermined speed ranges, e.g. speed range A of 0–0.05 m/sec., speed range B of 0.05–0.10 m/sec. and speed range C of 0.10–0.15 m/sec. Although higher-pitch notes are allocated to the higher moving speed ranges in the illustrated example, higher-pitch notes may be allocated to the lower moving speed ranges. Here, the settings stored in the tone signal table 47 are rewritable, and the user can register desired settings in the tone signal table 47.

The tone signal generation section 46 generates tone signals on the basis of the various items of the movement trajectory information supplied by the movement trajectory detection section 45, by referring to the above-described tone signal table 47. More specifically, when the operation terminal 11 is moved by the human operator in a circular trajectory of one clockwise revolution, and if the trajectory size is "medium" and the moving speed is in "speed range C", various items of movement trajectory information corresponding to the movement of the operation terminal 11 are generated by the movement trajectory detection section 45 and then supplied to the tone signal generation section 46. In turn, the tone signal generation section 46 selects the "piano" tone color parameter registered in association with the "circular trajectory shape of one clockwise revolution", the "medium" tone volume parameter registered in association with the "medium" trajectory size, and the "E" scale note parameter registered in association with the "C" moving speed range. Thus, the tone signal generation section 46 generates a tone signal for audibly sounding a tone corresponding to the "E" note with the piano tone color and "medium" tone volume.

Each of the tone signals thus generated by the tone signal generation section 46 is fed to the sound speaker system 42, which audibly sounds a tone corresponding to the tone signal.

A-2. Tone Generation Method:

Now, a description will be made about a method by which the human operator uses the above-described tone signal generation system 100 to generate tones. First, the human operator powers up (turns on the power to) the personal computer system 10 and operation terminal 11 constituting the tone signal generation system 100, so that the personal computer system 10 is caused to execute the tone generation processing programs.

Then, the human operator makes motions, such as swings of his or her hand grasping the operation terminal 11, in such a manner that the operation terminal 11 is moved in a desired movement trajectory. As the human operator moves the operation terminal 11 like this, the acceleration of the operation terminal 11 in the x- and y-axis directions is detected by the motion sensor MS of the operation terminal 11, and then delivered to the personal computer system 10. Thus, the personal computer system 10 generates movement trajectory information of the operation terminal 11 moved by the human operator, on the basis of the acceleration in the x- and y-axis directions supplied from the operation terminal 11. Then, a tone signal is generated on the basis of the thus-generated movement trajectory information, so that a tone is audibly sounded.

Because the correspondency between the various items of the movement trajectory information and the tone generating parameters is registered in the tone signal table 47 as noted above, the instant embodiment permits generation of a desired tone if the human operator moves the operation terminal 11 intentionally along a given movement trajectory taking the registered contents of the table 47 into account. For example, in the case where the settings illustratively shown in FIG. 18 are registered in the tone signal table 47 and if the human operator wants to generate a tone of the "C" note with the "piano" tone color and "medium" tone volume, the human operator moves the operation terminal 11 to draw a circular trajectory shape of one clockwise revolution in such a manner that the size of the circular trajectory falls within the "medium" size range and the moving speed falls within the "C" speed range. Namely, a desired tone can be generated by the instant embodiment if the human operator manipulates the operation terminal 11 intentionally taking the registered contents of the table 47 into account.

Further, the tone generation method using the tone signal generation system 100 can provide a novel form of musical entertainment as follows. While the conventional acoustic and electronic musical instruments are constructed to generate a desired tone in response to player's operation of a selected one of performance operators (e.g., keys of a piano or strings of a guitar), the tone signal generation system 100 can generate a desired tone in response to motions of the human operator moving the operation terminal 11 in a predetermined movement trajectory, rather than in response to operation of a selected performance operator. Namely, with the conventional acoustic and electronic musical instruments, etc. better performing operability, such as in selective manipulation, by fingers, of the performance operators, is pursued for a better performance. By contrast to the conventional tone signal generation systems (musical instruments) pursing the performing operability as above, the instant embodiment can implement a novel musical entertainment system which, by associating the tone generation with relatively big movements of the operation terminal 11 carried by the human operator, is capable of not only performing the tone generating function but also allowing the user or human operator to take part in control of the tones through his or her body motions.

Further, when a desired music piece or the like is to be performed by the tone generation scheme using the above-described tone signal generation system 100, the human operator can perform the music piece by referring to a novel form of musical score (hereinafter "movement-trajectory-descriptive" musical score) where shapes, sizes, speeds, etc. of movement trajectories of the operation terminal are described in a time series, in place of the musical score, such as the staff notation, commonly used in conventional musical instrument performances; the movement-trajectory-descriptive musical score used in the present invention may describe individual motions, constituting the movement trajectory, in graphics representative, for example, of dancing motions. The movement-trajectory-descriptive musical score corresponds in contents to settings registered in the above-described tone signal table 47, and thus as the registered contents of the tone signal table 47 are varied, the motions of the human operator moving the operation terminal 11 are varied in conformity with the varied tone signal 47 even when the same music piece is to be performed. That is, if the registered settings in the tone signal table 47 are varied, the music piece performance using the tone signal generation system 100 requires the human operator to make different motions even for the same music piece. Therefore, by varying the settings of the tone signal table 47 as appropriate, the user of the personal computer system 10 can independently create original movement trajectories to be drawn or followed by the operation terminal 11 for performing a given music piece, i.e. original motions of the human operator carrying the operation terminal 11. If the original motions of the human operator are created like this, stored contents or settings of the tone signal table 47 for executing the original motions, movement-trajectory-descriptive musical score corresponding to the settings, etc. can be supplied to some other person such as a friend. If the settings of the tone signal table 47, movement-trajectory-descriptive musical score corresponding to the settings and the like are supplied to some other person as above and if the supplied settings are registered into the tone signal table 47 and motions are made exactly to the movement-trajectory-descriptive musical score, the other person too can perform the music piece in just a similar manner to the user who created the movement trajectories or original motions.

Further, by the use of the tone signal generation system 100, it is also possible to construct a novel business model in accordance with which a service provider supplies a user with settings of the tone signal table 47, movement-trajectory-descriptive musical score indicative of motions of a human operator, etc. that can be created as noted above. More specifically, data describing the registered contents of the tone signal table 47 can be supplied from the service provider to the user or human operator by means of a CD-ROM (Compact Disk-Read-Only Memory) or via the Internet, and if the registered contents described by the data are set, the movement-trajectory-descriptive musical score for performing a given music piece can be supplied in a written sheet or book or in a storage medium having the data recorded thereon.

A-3-1. First Modification of the First Embodiment:

Whereas the first embodiment has been described above as allocating the shapes of the movement trajectory to the control of the tone color parameters, the sizes of the movement trajectory to the control of the tone volume parameters and the speeds of the movement trajectory to the control of the scale note parameters, the present invention is not necessarily limited to such allocation of the items of the movement trajectory information to the parameters to be controlled, and the allocation may be made in any other desired manner. For example, the scale note parameter may be controlled in accordance with the trajectory shape; as an example, the "circular trajectory shape of one clockwise revolution" may be allocated to scale note "C", the "circular trajectory shape of one counterclockwise revolution" may be allocated to scale note "D", and so on.

A-3-2. Second Modification of the First Embodiment:

According to the above-described first embodiment of the present invention, the operation terminal 11 is constructed to detect acceleration in the x- and y-axis directions by means of the motion sensor MS and transmits the thus-detected acceleration to the personal computer system 10, so that the personal computer system 10 generates a tone signal. The present invention is not so limited, and a single apparatus capable of being carried by the human operator may include built-in construction for implementing functions similar to the function of the operation terminal 11 and the tone generating function of the personal computer system 10. For example, in the arrangement of FIG. 4, the wireless (radio) transmitting/receiving functions may be dispensed with, and the remaining functions may be incorporated together within the operation terminal 11.

Figure 19:
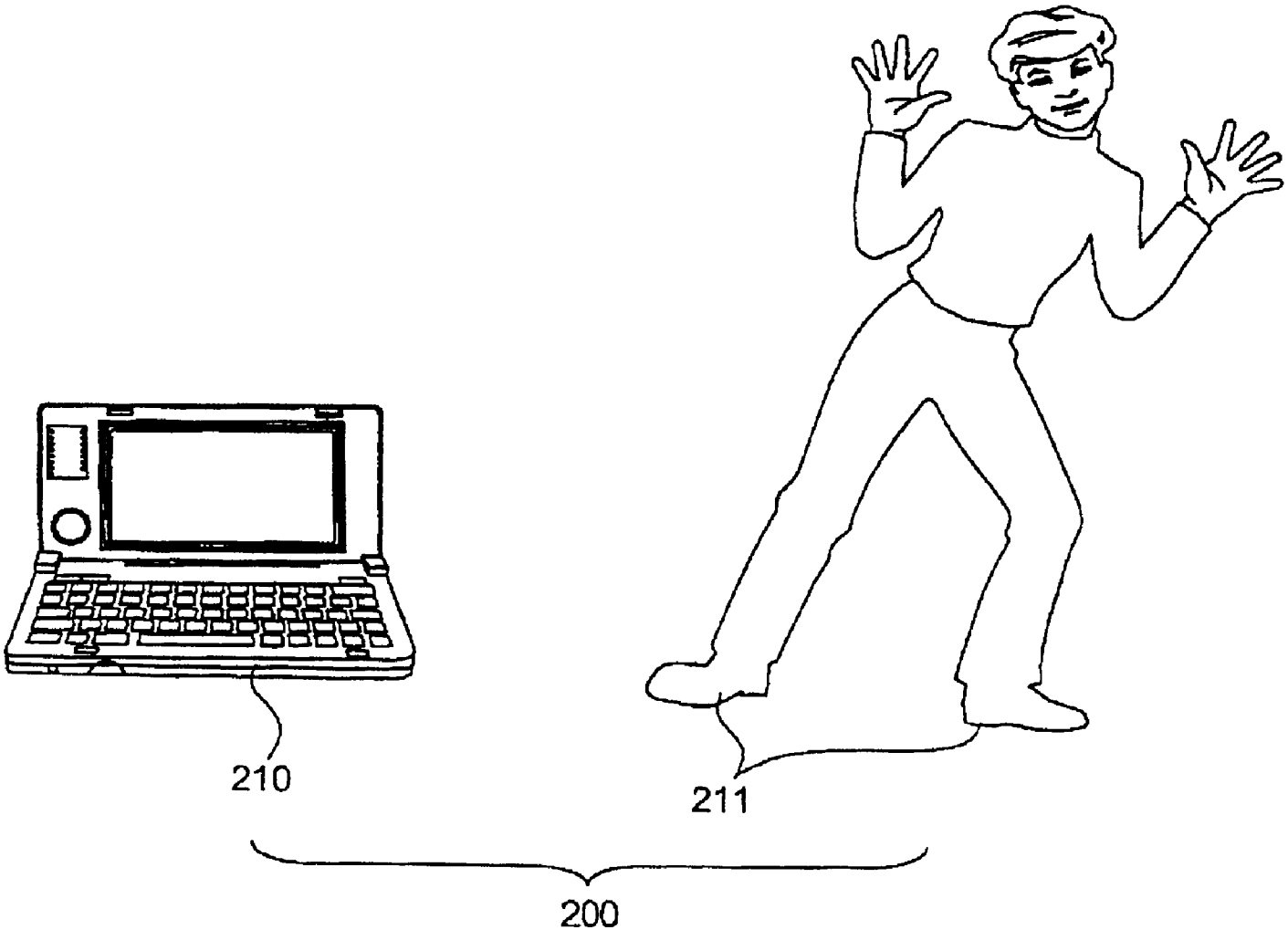
FIG. 19 is a view showing an overall external appearance of a tone signal generation system in accordance with a second embodiment of the present invention.

B. Second Embodiment:

FIG. 19 is a view showing an overall external appearance of a tone signal generation system in accordance with a second embodiment of the present invention. In the second embodiment, elements similar to those in the first embodiment are denoted by the same reference characters as in the first embodiment and will not be described here to avoid unnecessary duplication. As shown, the tone signal generation system 200 in accordance with the second embodiment includes a personal computer system 210, and a pair of shoe-type operation terminals 211 that can be worn by and thereby attached to a human operator.

The shoe-type operation terminals 211 are generally in the form of shoes, and for tone generation using the tone signal generation system 200, the human operator wears the shoe-type operation terminals 211. In this tone signal generation system 200, the human operator wearing the shoe-type operation terminals 211 tap-dances so that the personal computer system 210 generates tone signals in response to tap-dancing motions of the human operator.

Each of the shoe-type operation terminals 211 is constructed in a generally similar manner to the operation terminals 11 employed in the above-described first embodiment (see FIG. 2). However, the motion sensor MS of this operation terminal 211 comprises a strain sensor while the motion sensor MS of the operation terminal 11 in the first embodiment comprises the two-dimensional acceleration sensor. Note that the motion sensor MS of the operation terminal 211 in the second embodiment may comprise any other suitable sensor than the strain sensor, such as a pressure sensor.

Figure 20:
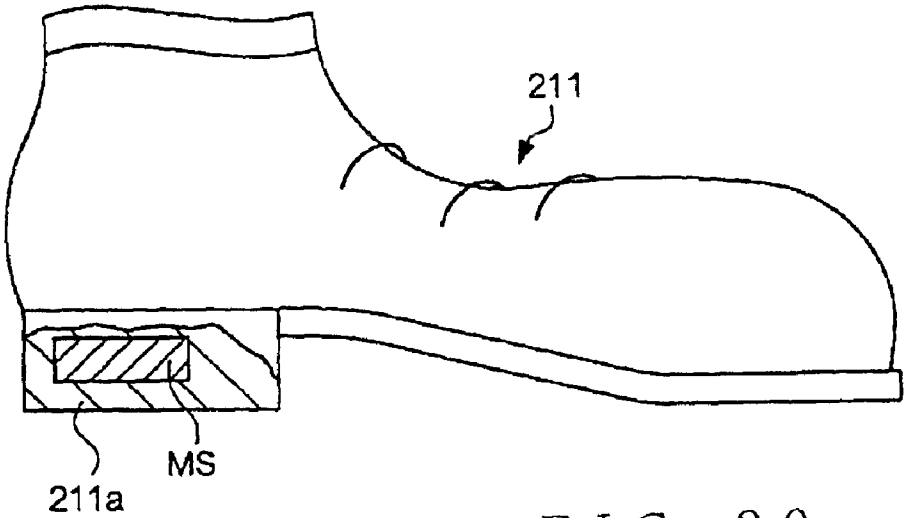
FIG. 20 is a block diagram showing an exemplary external appearance of a shoe-type operation terminal in the tone signal generation system of FIG. 19.

As shown in FIG. 20, the motion sensor MS of the shoe-type operation terminal 211 is disposed within a heel portion 211*a* of the shoe to detect strain in a vertical direction. Here, the heel portion 211*a* is made of a material capable of slight resilient deformation, such as that used in the heel portion of an ordinary shoe. As the human operator wearing the shoe-type operation terminals 211 tap-dances, the heel portion 211*a* resiliently deforms due to impact against a floor, and the motion sensor MS detects an amount of vertical displacement caused by the deformation of the heel portion 211*a*. Information indicative of the thus-detected displacement amount is transmitted wirelessly from the shoe-type operation terminal 211 to the personal computer system 210, as with the shoe-type operation terminal 11 in the first embodiment. In this case, because such displacement amount information is transmitted from the two shoe-type operation terminals 211, information identifying the left foot or right foot is transmitted from each of the operation terminals 211 along with the displacement amount information.

Figure 21:
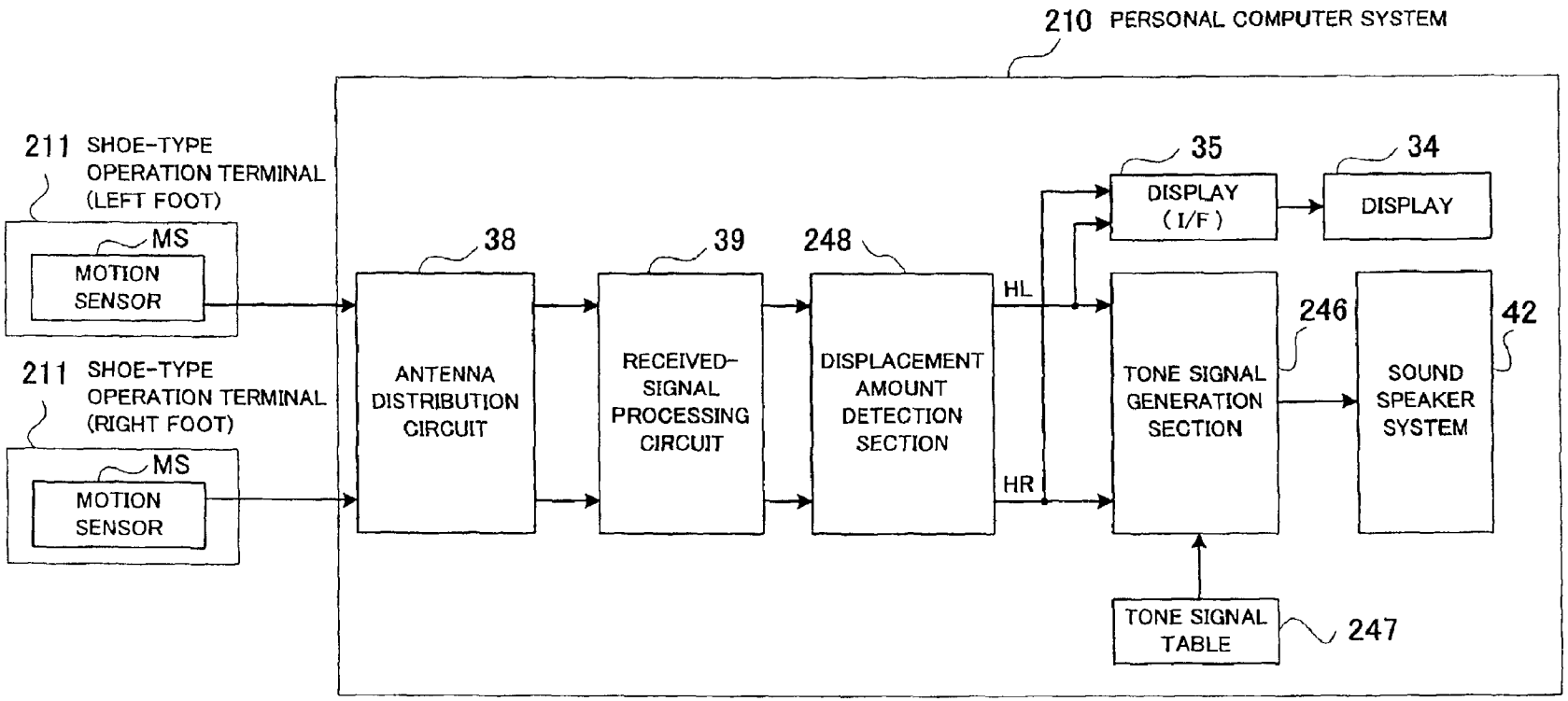
FIG. 21 is a block diagram showing an exemplary general setup and functions of the tone signal generation system of FIG. 19.
Figure 22:
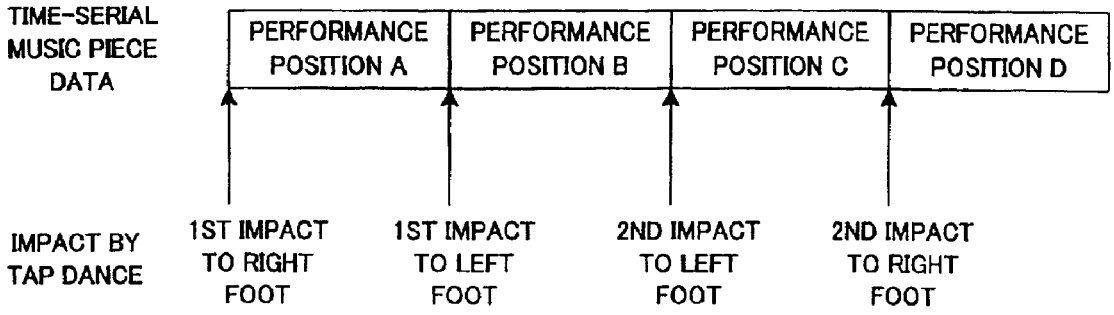
FIG. 22 is a diagram explanatory of a method for controlling progression of a music piece performance in accordance with tap-dancing motions of the human operator in the tone signal generation system of FIG. 19.

The personal computer system 210 in the second embodiment has a hardware setup similar to that of the personal computer system 10 in the first embodiment (see FIG. 3). However, the personal computer system 210 in the second embodiment is arranged to perform a tone generation process corresponding to the displacement amount information transmitted from the above-described shoe-type operation terminals 11, by executing the tone generation processing programs. The following paragraphs describe functions and construction of the personal computer system 210 focusing on the tone generation process, with primary reference to FIG. 21.

As shown, for the tone generation purposes, the personal computer system 210 includes an antenna distribution circuit 38, a received-signal processing circuit 39, a displacement amount detection section 248, a tone signal generation section 246, a tone signal table 247, a display device 34, a display interface (I/F) 35 and a sound speaker system 42.

In the second embodiment, the antenna distribution circuit 38 receives signals indicative displacement amounts of the left and right feet transmitted from the two shoe-type operation terminals 211 disposed on the left and right feet of the human operator and passes the received displacement amount signals to the received-signal processing circuit 39.

The received-signal processing circuit 39 passes the signals indicative the displacement amounts of the left and right feet, supplied from the antenna distribution circuit 38, through a predetermined band-pass filter section to thereby remove unnecessary frequency components. The signals indicative the displacement amounts of the left and right feet having the unnecessary frequency components removed therefrom are delivered from the received-signal processing circuit 39 to the displacement amount detection section 248.

From the signals indicative the displacement amounts of the left and right feet delivered from the processing circuit 39, the displacement amount detection section 248 obtains displacement amount information HL indicative of the displacement amount of the left foot and displacement amount information HR indicative of the displacement amount of the right foot, and outputs the thus-obtained displacement amount information HL and HR to the tone signal generation section 246 and display interface 35. The tone signal generation section 246 generates tone signals corresponding to the left and right feet, by reference to the tone signal table 247 and on the basis of the displacement amount information HL and HR of the left and right feet supplied from the received-signal processing circuit 39. In the tone signal table 247, there are prestored different pieces of tone waveform information in association with various possible displacement values indicated by the displacement amount information. More specifically, tones generated as ordinary tap-dancing shoes tapped on the floor with various different intensities of force were recorded in advance, and then different pieces of tone waveform information were prestored in the tone signal table 247 in association with various possible displacement values on the basis of the thus-recorded tones.

For each of the left and right feet, the tone signal generation section 246 selects one of the prestored pieces of tone waveform information which corresponds to the displacement value indicated by the displacement amount information supplied by the displacement amount detection section 248, and generates a tone waveform signal on the basis of the selected tone waveform information. The tone signal generation section 246 outputs the thus-generated tone waveform signal to the sound speaker system 42, so as to permit tap sound generation corresponding to the force applied to the heel portions 211*a* of the shoe-type operation terminals 211. Further, the displacement amount information HL and HR of the left and right feet is supplied from the displacement amount detection section 248 to the display interface 35, and thus the displacement amounts of the left and right feet are visually displayed on the display device 34. Here, the displacement amounts may be displayed in any desired manner, such as in numerical values representing the displacement amounts. Alternatively, the left and right shoes may be displayed in graphics with display color varied in accordance with the displacement amounts. The human operator can use the displayed contents on the display device 34 as reference information in judging with which intensity he or she should tap on the floor.

Even in a situation where there is provided no suitable floor surface for the tap-dancing motions and thus the human operator has to tap-dance on an ordinary floor surface (such as a surface of a Japanese "tatami" mat or carpet) in an ordinary house, the tone signal generation system 200 in accordance with the second embodiment can simulatively generate tap sounds corresponding to the tap-dancing motions.

Note that in the second embodiment, a plurality of tone signal tables 247 of different contents may be provided previously in corresponding relation to various floor surface materials, such as a carpet, tatami and wood) so as to permit the above-described simulative tone generation on floor surfaces made of various materials. In this case, once the human operator selects a desired one of the floor surface materials and inputs the selected material into the personal computer system 210, any one of the tone signal tables 247 is selectively used in accordance with the input floor surface material.

Further, although the second embodiment has been described as generating tap sounds corresponding to the displacement amount information supplied from the shoe-type operation terminals 211, the present invention is not so limited, and any other desired types of sounds or tones than the tap sounds may be generated.

Furthermore, a music piece performance may be controlled, in accordance with the displacement amounts supplied from the shoe-type operation terminals 211, in addition to the tap sound generation. For example, where the human operator tap-dances to a music piece performance, progression of reproduction, by the personal computer system 210, of the music piece performance may be controlled in accordance with the displacement amounts supplied from the shoe-type operation terminals 211. In this case, impacts applied to the shoe-type operation terminals 211 attached to the left and right feet are prestored in the tone signal table 246 in association with positions of a music piece data set to be performed in response to the applied impact. The illustrated example may be arranged such that when a first impact applied to the right foot is detected, the personal computer 210 may reproduce a portion of the music piece data set at performance position "A", and when a first impact applied to the left foot is detected, the personal computer 210 may reproduce a portion of the music piece data set at performance position "B". Here, the impact may be detected when the displacement amount indicated by the displacement amount information supplied from the shoe-type operation terminal 211 has exceeded a predetermined value.

Figure 23:
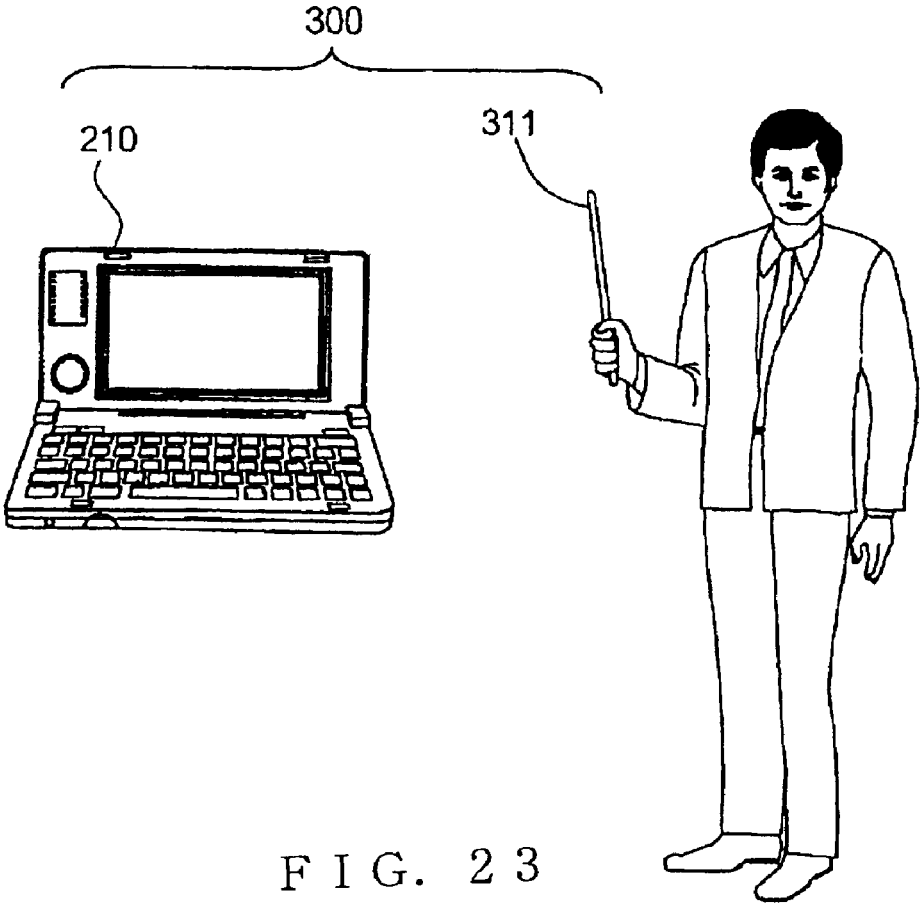
FIG. 23 is a block diagram showing an exemplary external appearance of a modification of the tone signal generation system shown in FIG. 19.

Further, whereas the second embodiment has been described as the system using the shoe-type operation terminals 211 to generate tone signals in response to tap-dancing motions, the present invention may be implemented as a tone signal generation system 300 using a stick-shaped operation terminal 311 as shown in FIG. 23.

Figure 24:
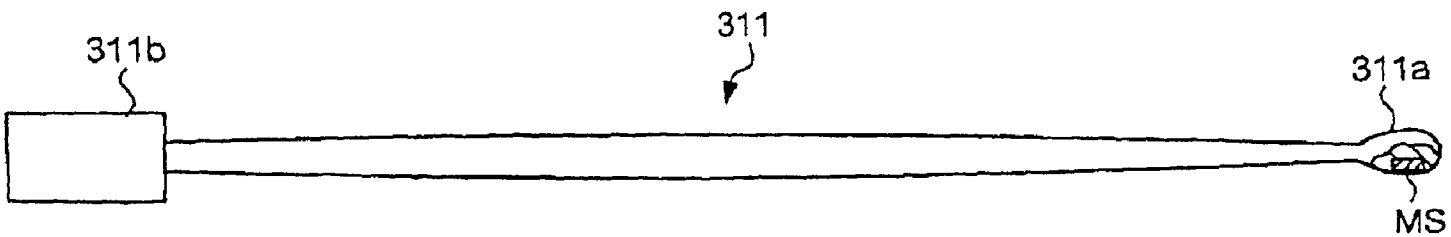
FIG. 24 is a block diagram showing an exemplary external appearance of a stick-shaped operation terminal in the modification of the tone signal generation system of FIG. 23.

As illustrated in FIG. 24, the stick-shaped operation terminal 311 in the modified tone signal generation system 300 has an external appearance substantially similar to that of a drumstick, and a motion sensor MS is incorporated within a distal end portion 311*a* of the stick-shaped operation terminal 311. The motion sensor MS in this stick-shaped operation terminal 311 comprises a strain sensor as in the second embodiment. The tone signal generation system 300 of FIG. 23 is similar in construction to the above-described first embodiment (see FIG. 2), except for the motion sensor MS; that is, transmitter CPU and other elements constituting the tone signal generation system 300 are similar to those employed in the first embodiment. The transmitter CPU and other elements are disposed within a box 311*b* at the proximal end of the stick-shaped operation terminal 311. For tone generation using the stick-shaped operation terminal 311, the human operator hits a wall or desk with the tip end portion 311*a* of the operation terminal 311, and the motion sensor MS detects an amount of displacement of the tip end portion 311*a* caused by the hitting motion. Information indicative of the detected displacement amount is transmitted wirelessly to the personal computer system 210.

In the tone signal table 247 of the personal computer system 210, there are prestored various different pieces of tone waveform information for generating drum sounds, in place of the above-mentioned tap sounds, in association with various possible displacement amounts of the tip portion 311*a*. Thus, when the human operator hits a wall or the like with the tip end portion 311*a* of the operation terminal 311, a drum sound corresponding to the hitting intensity is generated by the personal computer system 210. Namely, a drum sound can be generated by the human operator hitting the tip end portion 311*a* of the operation terminal 311 against a suitable object.

In each of the second embodiment and its modification, the shoe-type operation terminal 211 or stick-shaped operation terminal 311 is provided separately from the personal computer system 210. In an alternative, the shoe-type operation terminal 211 and/or stick-shaped operation terminal 311 may include built-in hardware capable of performing a tone generation process similar to that performed by the personal computer system 210, so as to dispense with the personal computer system 210 and provide an integrated (tone generator-operation terminal) apparatus that can be carried by the human operator.

In summary, the present invention arranged in the above-described manner can generate tone signals reflecting human operator's motions.

What is claimed is:

1. A tone signal generation system comprising:

an operation terminal that is capable of being carried by a human operator and that generates and transmits motion information corresponding to a motion of the human operator carrying said operation terminal; and a tone signal generation apparatus that receives the motion information from said operation terminal and detects a movement trajectory of said operation terminal corresponding to the motion of the human operator on the basis of the received motion information, said tone signal generation apparatus generating a tone signal on the basis of the detected movement trajectory of said operation terminal, wherein said tone signal generation apparatus detects which one of a plurality of predetermined typical shapes a shape of the detected movement trajectory of said operation terminal corresponds to.

2. A tone signal generation system as claimed in claim 1 wherein said tone signal generation apparatus includes a table storing at least one possible movement trajectory of said operation terminal and at least one tone signal in association with each other, and said tone signal generation apparatus generates a tone signal by referring to stored contents of said table.

3. A tone signal generation system as claimed in claim 2 wherein the stored contents of said table are rewritable.

4. A tone signal generation system comprising:

an operation terminal that is capable of being carried by a human operator and that generates and transmits motion information corresponding to a motion of the human operator carrying said operation terminal; and a tone signal generation apparatus that receives the motion information from said operation terminal and detects a movement trajectory of said operation terminal corresponding to the motion of the human operator on the basis of the received motion information, said tone signal generation apparatus generating a tone signal on the basis of the detected movement trajectory of said operation terminal, wherein said tone signal generation apparatus determines a first parameter for generating a tone signal in accordance with a shape of the movement trajectory of said operation terminal, a second parameter for generating a tone signal in accordance with a size of the movement trajectory, and a third parameter for generating a tone signal in accordance with a moving speed or acceleration of the movement trajectory.

5. A tone signal generation system as claimed in claim 4 wherein each of said first, second and third parameters is a parameter for setting or controlling any one of tone color, tone volume, tone pitch and effect.

6. A tone signal generation system as claimed, in claim 1 wherein the plurality of predetermined typical shapes include at least one of a circular shape, shape of a numeral "8", obliquely-cut surface shape, elongated oval shape, rectangular shape and spiral shape.

7. A tone signal generation system as claimed in claim 1 wherein said tone signal generation apparatus detects, as the movement trajectory of said operation terminal, at least one of a plurality of trajectory elements including an approximate shape, approximate size and approximate moving speed or acceleration of the movement trajectory.

8. A tone signal generation apparatus comprising:

a receiver that receives motion information transmitted from an operation terminal capable of being carried by a human operator, the motion information corresponding to a motion of the human operator carrying the operation terminal;

a processing section that detects a movement trajectory corresponding to the motion of the human operator on the basis of the motion information received by said receiver; and a tone signal generation section that generates a tone signal on the basis of the movement trajectory of the operation terminal detected by said processing section, wherein said processing section detects which one of a plurality of predetermined typical shapes a shape of the detected movement trajectory of said operation terminal corresponds to.

9. A tone signal generation system comprising:

an operation terminal that is capable of being carried by a human operator and has a predetermined portion made of an elastically-deformable material, said operation terminal including a sensor positioned within the predetermined portion for detecting an amount of displacement, caused by deformation, of the predetermined portion, said operation terminal transmitting displacement amount information indicative of the amount of displacement detected via the sensor; and a tone signal generation apparatus that receives the displacement amount information transmitted from said operation terminal and generates a tone signal on the basis of the received displacement amount information, wherein said tone signal generation apparatus, in accordance with the displacement amount information received from said operation terminal, refers to a tone signal table having stored therein various displacement amount values to be indicated by pieces of displacement amount information and pieces of tone waveform information in association with each other, so as to read out one of the pieces of tone waveform information corresponding to the detected amount of displacement indicated by the received displacement amount information, said tone signal generation apparatus generating the tone signal on the basis of the read-out tone waveform information and wherein a plurality of the tone signal tables are prepared in advance for individual ones of different contact surface materials, and any one of the tone signal tables is selectable by the human operator.

10. A tone signal generation system as claimed in claim 9 wherein said operation terminal is in the form of a shoe wearable by the human operator, and said predetermined portion is a bottom of the shoe.

11. A tone signal generation apparatus capable of being carried by a human operator, said tone signal generation apparatus comprising:

a sensor section that generates motion information corresponding to a motion of the human operator carrying said tone signal generation apparatus;

a processing section that detects a movement trajectory of said tone signal generation apparatus corresponding to the motion of the human operator on the basis of the motion information generated by said sensor section; and a tone signal generation section that generates a tone signal on the basis of the movement trajectory detected by said processing section, wherein said processing section detects which one of a plurality of predetermined typical shapes a shape of the detected movement trajectory of said tone signal generation apparatus corresponds to.

12. A method of generating a tone signal corresponding to a motion of a human operator carrying an operation terminal, said method comprising:

a step of detecting a movement trajectory of said operation terminal corresponding to the motion of the human operator; and a step of generating a tone signal on the basis of the movement trajectory detected by said step of detecting, wherein said step of detecting detects which one of a plurality of predetermined typical shapes a shape of the detected movement trajectory of said operation terminal corresponds to.

13. A method of generating a tone signal corresponding to a motion of a human operator carrying an operation terminal, said method comprising:

a detection step of detecting an amount of displacement, caused by deformation, of a predetermined portion, made of an elastically-deformable material, of said operation terminal; and a tone signal generation step of generating a tone signal on the basis of the received information indicative of the amount of displacement detected by said detection step, wherein in accordance with the displacement amount information received from said operation terminal, said method including a step of referring to a tone signal table having stored therein various displacement amount values to be indicated by pieces of displacement amount information and pieces of tone waveform information in association with each other, so as to read out one of the pieces of tone waveform information corresponding to the detected amount of displacement indicated by the received displacement amount information, said tone signal generation step generating the tone signal on the basis of the read-out tone waveform information and wherein a plurality of the tone signal tables are prepared in advance for individual ones of different contact surface materials, and any one of the tone signal tables is selectable by the human operator.

14. A computer program comprising computer program code means for performing all the steps of claim 12 when said program is run on a computer.

15. A computer program comprising computer program code means for performing all the steps of claim 13 when said program is run on a computer.

16. A machine-readable storage medium containing a group of instructions to cause said machine to perform a method of generating a tone signal corresponding to a motion of a human operator carrying an operation terminal, said method comprising:

a step of detecting a movement trajectory of said operation terminal corresponding to the motion of the human operator; and a step of generating a tone signal on the basis of the movement trajectory detected by said step of detecting, wherein said step of detecting detects which one of a plurality of predetermined typical shapes a shape of the detected movement trajectory of said operation terminal corresponds to.

17. A machine-readable storage medium containing a group of instructions to cause said machine to perform a method of generating a tone signal corresponding to a motion of a human operator carrying an operation terminal, said method comprising:

a detection step of detecting an amount of displacement, caused by deformation, of a predetermined portion, made of an elastically-deformable material, of said operation terminal; and a tone signal generation step of generating a tone signal on the basis of the received information indicative of the amount of displacement detected by said detection step, wherein in accordance with the displacement amount information received from said operation terminal, said method including a step of referring to a tone signal table having stored therein various displacement amount values to be indicated by pieces of displacement amount information and pieces of tone waveform information in association with each other, so as to read out one of the pieces of tone waveform information corresponding to the detected amount of displacement indicated by the received displacement amount information, said tone signal generation step generating the tone signal on the basis of the read-out tone waveform information and wherein a plurality of the tone signal tables are prepared in advance for individual ones of different contact surface materials, and any one of the tone signal tables is selectable by the human operator.

* * * * *